US010098391B2

(12) United States Patent
Gordon et al.

(10) Patent No.: US 10,098,391 B2
(45) Date of Patent: Oct. 16, 2018

(54) APPAREL ARTICLE TO PRE-COOL THE BODY

(71) Applicant: adidas AG, Herzogenaurach (DE)

(72) Inventors: Josh Robert Gordon, Herzogenaurach (DE); Trudy Anne Watson, Herzogenaurach (DE); David O'Mahony, Herzogenaurach (DE); Maarten Dominique Wilhelmus Hupperets, Herzogenaurach (DE); Stephen Henry Faulkner, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 325 days.

(21) Appl. No.: 14/633,484

(22) Filed: Feb. 27, 2015

(65) Prior Publication Data

US 2016/0249691 A1 Sep. 1, 2016

(51) Int. Cl.

| | |
|---|---|
| ***A41D 13/005*** | (2006.01) |
| ***A41D 1/04*** | (2006.01) |
| ***A41D 27/10*** | (2006.01) |

(52) U.S. Cl.

CPC ..... *A41D 13/0053* (2013.01); *A41D 1/04* (2013.01); *A41D 27/10* (2013.01); *A41D 2600/10* (2013.01)

(58) Field of Classification Search

CPC .. A41D 13/005; A41D 13/0518; A41D 27/10; A41D 1/04; A41D 13/0053; A41D 13/0055

USPC ..... 2/102, 108, 458, 69, 81, 82, 85, 93; 62/259, 3, 371; 165/10, 46, 136; 428/68; 607/108

See application file for complete search history.

(56) References Cited

U.S. PATENT DOCUMENTS

| | | | | |
|---|---|---|---|---|
| 4,856,294 | A * | 8/1989 | Scaringe | A41D 13/0055 165/46 |
| 5,415,222 | A * | 5/1995 | Colvin | A41D 13/0053 165/136 |
| 5,647,226 | A * | 7/1997 | Scaringe | C09K 5/066 62/371 |
| 5,722,482 | A * | 3/1998 | Buckley | A61F 7/02 165/10 |
| 5,755,110 | A * | 5/1998 | Silvas | A41D 13/0053 165/46 |

(Continued)

OTHER PUBLICATIONS

Arngrimsson et al., "Relation of Heart Rate to Percent VO2 Peak During Submaximal Exercise in the Heat", Journal of Applied Physiology, vol. 94, 2003, pp. 1162-1168.

(Continued)

*Primary Examiner* — Gloria Hale

(74) *Attorney, Agent, or Firm* — Kilpatrick Townsend & Stockton LLP

(57) ABSTRACT

Described are articles of wear having a base layer, a plurality of cooling zones positioned on the base layer so that substantially all of the plurality of cooling zones are positioned adjacent regions of a wearer's body having highly efficient heat transfer properties of a wearer when worn, and cooling material contained within the plurality of cooling zones. The article of wear is configured to reduce a wearer's body heat content through heat transfer from each region having highly efficient heat transfer properties to each cooling zone when the cooling material is pre-cooled prior to wearing.

21 Claims, 20 Drawing Sheets

(56) References Cited

U.S. PATENT DOCUMENTS

| | | | | |
|---|---|---|---|---|
| 6,125,645 | A * | 10/2000 | Horn | A41D 13/0056 2/458 |
| 7,089,995 | B2 | 8/2006 | Koscheyev et al. | |
| 8,585,746 | B2 | 11/2013 | Ilcheva et al. | |
| 2005/0227037 | A1* | 10/2005 | Booska | C09K 5/063 428/68 |
| 2007/0299489 | A1* | 12/2007 | Francis, Jr. | A41D 13/0058 607/108 |
| 2009/0062892 | A1* | 3/2009 | Ilcheva | A41D 13/0518 607/108 |
| 2009/0217440 | A1* | 9/2009 | Sutker | A41D 13/0058 2/114 |
| 2011/0022137 | A1* | 1/2011 | Ennis-Thomas | A41D 13/0053 607/108 |
| 2011/0239346 | A1* | 10/2011 | Doherty | A41D 13/0058 2/2.5 |
| 2011/0239682 | A1* | 10/2011 | Raines | A61F 7/10 62/259.3 |
| 2014/0317825 | A1* | 10/2014 | Silverberg | A41D 13/1209 2/69 |
| 2015/0000004 | A1* | 1/2015 | Silverberg | A41D 13/0058 2/69 |
| 2015/0026862 | A1* | 1/2015 | Silverberg | A41D 13/0058 2/69 |
| 2016/0249691 | A1* | 9/2016 | Gordon | A41D 13/0053 |
| 2017/0013890 | A1* | 1/2017 | Byrne | A41D 13/0058 |

OTHER PUBLICATIONS

Ashrae , "Thermal Comfort", ASHRAE Handbook of Fundamentals, 1997, pp. 8.1-8.26.

Bogerd et al., "The Effect of a Hot Climate and External Cooling on Graded Cycling Performance", Environmental Ergonomics, vol. 35, 2005, 4 pages.

Bogerd et al., "The Effect of Pre-Cooling Intensity on Cooling Efficiency and Exercise Performance", Journal of Sports Sciences, vol. 28, No. 7, 2010, pp. 771-779.

Borg et al., "Psychophysical Bases of Perceived Exertion", Med. Sci. Sports Exerc., vol. 14, 1982, pp. 377-381.

Castle et al., "Precooling Leg Muscle Improves Intermittent Sprint Exercise Performance in Hot, Humid Conditions", J. Appl. Physiol. vol. 100, No. 4, Apr. 2006, pp. 1377-1384.

Cheuvront et al., "Hypohydration Impairs Endurance Exercise Performance in Temperate but Not Cold Air", J. Appl. Physiol., vol. 99, No. 5, Nov. 1, 2005, pp. 1972-1976.

Crewe et al., "The Rate of Increase in Rating of Perceived Exertion Predicts the Duration of Exercise to Fatigue at a Fixed Power Output in Different Environmental Conditions", Eur. J. Appl. Physiol. vol. 103, 2008, pp. 569-577.

Duffield et al., "Precooling can Prevent the Reduction of Self-Paced Exercise Intensity in the Heat", Med. Sci. Sports Exerc., vol. 42, 2010, pp. 577-584.

Dugas , "Ice Slurry Ingestion Increases Running Time in the Heat", Clin. J. Sport Med., vol. 21, 2011, pp. 541-542.

Ely et al., "Aerobic Performance is Degraded, Despite Modest Hyperthermia, in Hot Environments", Med. Sci. Sports Exerc., vol. 42, No. 1, 2010, pp. 135-141.

Galloway et al., "Effects of Ambient Temperature on the Capacity to Perform Prolonged Cycle Exercise in Man", Medical & Science in Sports & Exercise, vol. 29, 1997, pp. 1240-1249.

Gonzalez-Alonso et al., "Influence of Body Temperature on the Development of Fatigue During Prolonged Exercise in the Heat", Journal of Applied Physiology, vol. 86, 1999, pp. 1032-1039.

Griffiths et al., "Performance and Thermal Comfort", Ergonomics, vol. 14, 1971, pp. 457-468.

Hardy et al., "Basal Metabolism, Radiation, Convection and Vaporisation at Temperatures of 22 to 35°", J. Nutr., vol. 15, No. 5, May 1, 1938, pp. 477-497.

Hessemer et al., "Effect of Slightly Lowered Body Temperatures on Endurance Performance in Humans", J. Appl. Physiol. vol. 57, No. 6, Dec. 1, 1984, pp. 1731-1737.

Jackson et al., "Generalized Equations for Predicting Body Density of Men", The British Journal of Nutrition, vol. 40, Nov. 1978, pp. 497-504.

Jay et al., "Current Evidence Does Not Support an Anticipatory Regulation of Exercise Intensity Mediated by Rate of Body Heat Storage", Journal of Applied Physiology, vol. 107, 2009, pp. 630-631.

Jeukendrup et al., "A New Validated Endurance Performance Test", Med. Sci. Sports Exerc., vol. 28, No. 2, 1996, pp. 266-270.

Johnson , "Mechanisms of Vasoconstriction with Direct Skin Cooling in Humans", Am. J. Physiol. Heart Circ. Physiol., vol. 292, No. 4, 2007, pp. H1690-H1691.

Kenefick et al., "Skin Temperature Modifies the Impact of Hypohydration on Aerobic Performance", Journal of Applied Physiology, vol. 109, 2010, pp. 79-86.

Latzka et al., "Hyperhydration: Tolerance and Cardiovascular Effects During Uncompensable Exercise-Heat Stress", Journal of Applied Physiology, vol. 84, 1998, pp. 1858-1864.

Lee et al., "Cold Drink Ingestion Improves Exercise Endurance Capacity in the Heat", Med. Sci. Sports Exerc., vol. 40, No. 9, 2008, pp. 1637-1644.

Lee et al., "Exercise Duration and Thermoregulatory Responses After Whole Body Precooling", J. Appl. Physiol., vol. 79, No. 6, 1995, pp. 1971-1976.

Marcora , "Counterpoint: Afferent Feedback from Fatigued Locomotor Muscles is Not an Important Determinant of Endurance Exercise Performance", J. Appl. Physiol., vol. 108, No. 2, 2010, pp. 454-456.

Marino , "Anticipatory Regulation and Avoidance of Catastrophe During Exercise-Induced Hyperthermia", Comparative Biochemistry and Physiology, vol. 139, Part B, 2004, pp. 561-569.

Marino , "Commentaries on Viewpoint: Current Evidence does Not Support an Anticipatory Regulation of Exercise Intensity Mediated by Rate of Body Heat Storage", Journal of Applied Physiology, vol. 107, 2009, pp. 632-634.

Montain et al., "Physiology Tolerance to Uncompensable Heat Stress: Effects of Exercise Intensity, Protective Clothing, and Climate", Journal of Applied Physiology, vol. 77, 1994, pp. 216-222.

Nielsen et al., "Human Circulatory and Thermoregulatory Adaptations With Heat Acclimation and Exercise in a Hot, Dry Environment", Journal of Physiology, vol. 460, 1993, pp. 467-485.

Noakes et al., "From Catastrophe to Complexity: A Novel Model of Integrative Central Neural Regulation of Effort and Fatigue during Exercise in Humans", Br. J. Sports Med., vol. 38, 2004, pp. 511-514.

Noakes et al., "From Catastrophe to Complexity: A Novel Model of Integrative Central Neural Regulation of Effort and Fatigue during Exercise in Humans: Summary and Conclusions", Br. J. Sports Med., vol. 39, 2005, pp. 120-124.

Perrey , "Comments on Point:Counterpoint: Afferent Feedback from Fatigued Locomotor Muscles is/is Not an Important Determinant of Endurance Exercise Performance", J. Appl. Physiol., vol. 108, 2010, pp. 458-468.

Sawka et al., "High Skin Temperature and Hydrohydration Impair Aerobic Performance", Experimental Physiology, vol. 97, 2012, pp. 327-332.

Schlader et al., "Skin Temperature as a Thermal Controller of Exercise Intensity", Eur. J. Appl. Physiol., vol. 111, 2011, pp. 1631-1639.

Schmidt et al., "Effect of a Precooling Maneuver on Body Temperature and Exercise Performance", J. Appl. Physiol., vol. 50 No. 4, 1981, pp. 772-778.

Siegel , "Ice Slurry Ingestion Increases Core Temperature Capacity and Running Time in the Heat", Med. Sci. Sports Exerc., vol. 42, No. 4, 2010, pp. 717-725.

Tatterson et al., "Effects of Heat Stress on Physiological Responses and Exercise Performance in Elite Cyclists", Journal of Science and Medicine in Sport, vol. 3, No. 2, 2000, pp. 186-193.

Tucker , "The Anticipatory Regulation of Performance: The Physiological Basis for Pacing Strategies and the Development of a

(56) References Cited

OTHER PUBLICATIONS

Perception-Based Model for Exercise Performance", Br. J. Sports Med., vol. 43, No. 6, 2009, pp. 392-400.
Tucker et al., "The Rate of Heat Storage Mediates an Anticipatory Reduction in Exercise Intensity during Cycling at a Fixed Rating of Perceived Exertion", J. Physiol., vol. 574 (Pt 3), 2006, pp. 905-915.
Vallerand et al., "How Should Body Heat Storage be Determined in Humans: By Thermometry or Calorimetry?", Eur. J. Appl. Physiol. Occup. Physiol., vol. 65, No. 3, 1992, pp. 286-294.
Watson et al., "Influence of Relative Humidity on Prolonged Exercise Capacity in a Warm Environment", British Journal of Sports Medicine, vol. 45, 2011, pp. A3-A4.
Wilson et al., "Skin-Surface Cooling Elicits Peripheral and Visceral Vasoconstriction in Humans", J. Appl. Physiol., vol. 103, No. 4, 2007, pp. 1257-1262.
Cohen, "Statistical Power Analysis for the Behavioral Sciences", Lawrence Erlbaum Associates, 1988.

* cited by examiner

APPAREL ARTICLE TO PRE-COOL THE BODY

FIELD OF THE INVENTION

The present invention relates to articles of wear comprising cooling zones that are designed to lower a wearer's body heat content when worn.

BACKGROUND

Endurance exercise performance is known to deteriorate as the surrounding ambient temperature increases (Galloway S. D. and Maughan R. J., *Effects of Ambient Temperature on the Capacity to Perform Prolonged Cycle Exercise in Man*, Med. Sci. Sports Exerc. 1997: 29: 1240-1249), which is further exacerbated when combined with increasing humidity. Watson P., Otani H., and Maughan R. J., *Influence of Relative Humidity on Prolonged Exercise Capacity in a Warm Environment*, British Journal of Sports Medicine 2011: 45: A3-A4. As a result, there appears to be a strong link between increases in thermoregulatory strain due to elevations in both metabolic and ambient heat, which may result in impaired endurance performance.

In particular, studies have proposed that endurance performance in hotter climates is limited by attainment of a critical core body temperature of approximately 40° C. Gonzalez-Alonso J., Teller C., Andersen S. L., Jensen F. B., Hyldig T., and Nielsen B., *Influence of Body Temperature on the Development of Fatigue during Prolonged Exercise in the Heat*, J. Appl. Physiol. 1999: 86: 1032-1039; Nielsen B., Hales J. R., Strange S., Christensen N. J., Warberg J., and Saltin B., *Human Circulatory and Thermoregulatory Adaptations with Heat Acclimation and Exercise in a Hot, Dry Environment*, J. Physiol. 1993: 460: 467-485. The body may use this critical core temperature as guide for setting judgment alteration and effort perception in an attempt to complete a given task as quickly as possible without achieving a dangerously high core temperature. Marino F. E., *Anticipatory Regulation and Avoidance of Catastrophe during Exercise-Induced Hyperthermia*, Comp. Biochem. Physiol. B. Biochem. Mol. Biol. 2004: 139: 561-569.

In addition to core temperature values, skin temperature in response to exercise has also been identified as a factor that the body uses to regulate endurance performance in hotter environments. Kenefick R. W., Cheuvront S. N., Palombo L. J., Ely B. R., and Sawka M. N., *Skin Temperature Modifies the Impact of Hypohydration on Aerobic Performance*, Journal of Applied Physiology 2010: 109: 79-86; Sawka M. N., Cheuvront S. N., and Kenefick R. W., *High Skin Temperature and Hypohydration Impair Aerobic Performance*, Experimental Physiology 2012: 97: 327-332. For example, when the environmental temperature is high, fatigue may set in when the skin temperature exceeds 35° C., even though the core temperature is less than 40° C. Latzka W. A., Sawka M. N., Montain S. J., Skrinar G. S., Fielding R. A., Matott R. P., and Pandolf K. B., *Hyperhydration: Tolerance and Cardiovascular Effects during Uncompensable Exercise-Heat Stress*, J. Appl. Physiol. 1998: 84: 1858-1864; Montain S. J., Sawka M. N., Cadarette B. S., Quigley M. D., and McKay J. M., *Physiological Tolerance to Uncompensable Heat Stress: Effects of Exercise Intensity, Protective Clothing, and Climate*, J. Appl. Physiol. 1994: 77: 216-222.

Various efforts have been made to extend endurance performance by extending the time before the body reaches an excessive core temperature and/or skin temperature. One of the most widely adopted practices is that of pre-cooling. Pre-cooling can be applied externally using a variety of methods such as cold air exposure, cold water immersion, ice vests, water perfused suits, phase change materials, and forearm cooling, internally via the use of cold drinks, or via combinations of these methods. The methods are geared toward achieving reduced body heat content prior to exercising and increasing the body's ability to store endogenous and exogenous heat and improve exercise performance.

While it has been found that external pre-cooling does achieve reduced body heat content and has a beneficial effect on endurance performance, it has also been found that certain applications can have an adverse effect. Specifically, pre-cooling applications that are too cold and/or are applied for too long can trigger the body's defensive mechanisms against falling body temperatures, causing the body to avoid or resist lowering the core temperature.

Furthermore, it is well known that different anatomical parts of the body experience differing rates of heat loss. U.S. Pat. No. 7,089,995 to Koscheyev et al. For example, discrete areas of the body having a higher efficiency in transferring heat to or from the body typically have a higher density of cells making up the body tissue along with a higher amount of vascularization in the body tissue. Such regions include area with little subcutaneous fat deposition, and a high density of blood vessels close to the skin surface. Examples include forearm, wrist, lateral thoracic area (rib cage), upper torso, paraspinal area, occipital and parietal head areas, gluteal and medial or inner thigh, shoulder, pectoral region, ankle, and groin area. Because of the greater heat transfer efficiency, these regions may be targeted for more effective control of body temperature during exposure to environmental extremes. Based on these differences among discrete regions of the body, pre-cooling may be ineffective if the pre-cooling application is applied to areas with lower heat transfer rates and/or applied too broadly so that energy is wasted by cooling areas where the cooling effect is not transferred as effectively.

As an example, U.S. Pat. No. 8,585,746 describes a vest that covers a torso area of an individual having chambers 30, 40 on the front and back of the vest that are filled with water (or ice when frozen). Because the chambers 30, 40 cover the entire front and back of the torso areas, the cooling areas of the vest are positioned adjacent a large surface area of the body, which does not target specific anatomical regions of the body having more efficient heat transfer rates. In body areas where vital organs are located, the use of ice cooling might actually be counter-effective in reducing body heat content. In addition, superficial muscles used during movement should be avoided as ice cooling moves muscle temperature away from its optimum. Furthermore, these chambers 30, 40 are sized to hold up to approximately a gallon of water, which can add approximately 3-4 kilograms to the weight of the vest when fully activated with water and after being placed in the freezer for the indicated amount of time. The additional weight of the vest makes it more difficult to wear the vest for long periods of time, and may counteract any beneficial results achieved by lowering the body heat content.

As a result, it may be desirable to provide a garment that is designed to provide pre-cooling to specific areas of the body having greater heat transfer efficiency, which uses a light-weight cooling material that reduces body heat content without adverse effects.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an article of wear comprises a base layer, a plurality of cooling zones being positioned on the base layer so that substantially all of the plurality of cooling zones are positioned adjacent regions of a wearer's body having highly efficient heat transfer properties of a wearer when worn, and cooling material contained within the plurality of cooling zones, wherein the article of wear is configured to reduce a wearer's body heat content through heat transfer from each region having highly efficient heat transfer properties to each cooling zone when the cooling material is pre-cooled prior to wearing.

In some embodiments, the base layer is a lightweight and flexible material. The cooling material may comprise a super absorbent material that converts to a semi-solid gel when mixed with water or an aqueous solution and/or may comprise a phase change material.

In some embodiments, the article of wear is at least one sleeve. The article of wear may further comprise a vest and a pair of sleeves.

According to certain embodiments, the wearer's body heat content is reduced by at least 0.3 degrees Celcius after 30 minutes of wear. Regions having highly efficient heat transfer properties may comprise at least regions in an upper portion of a back and each forearm of the wearer.

According to certain embodiments of the present invention, an article of wear comprising a vest and a pair of sleeves, each of the vest and the pair of sleeves comprises a base layer, a plurality of cooling zones being positioned on the base layer so that substantially all of the plurality of cooling zones are positioned adjacent regions of a wearer's body having highly efficient heat transfer properties of a wearer when worn, and a cooling material contained within the plurality of cooling zones, wherein the article of wear is configured to reduce a wearer's body heat content through heat transfer from each region having highly efficient heat transfer properties to each cooling zone when the cooling material is pre-cooled prior to wearing.

In some embodiments, the base layer is a lightweight and flexible material. The cooling material may comprise a super absorbent material that converts to a semi-solid gel when mixed with water or an aqueous solution and/or may comprise a phase change material.

According to certain embodiments, the wearer's body heat content is reduced by at least 0.3 degrees Celcius after 30 minutes of wear. Regions having highly efficient heat transfer properties may comprise at least regions in an upper portion of a back and each forearm of the wearer.

According to certain embodiments of the present invention, a method of using an article of wear comprising a base layer, a plurality of cooling zones positioned on the base layer, and a cooling material contained within the plurality of cooling zones, comprises activating the cooling material by wetting the article of wear, pre-cooling the article of wear, and positioning the article of wear on a wearer so that substantially all of the plurality of cooling zones are positioned adjacent regions of the wearer's body having highly efficient heat transfer properties of the wearer.

In some embodiments, the cooling material may comprise a super absorbent material that converts to a semi-solid gel when mixed with water or an aqueous solution.

According to certain embodiments, positioning the article of wear on the wearer so that substantially all of the plurality of cooling zones are positioned adjacent regions having highly efficient heat transfer properties of the wearer comprises positioning a pair of sleeves over each forearm and wrist of the wearer. Positioning the article of wear on the wearer so that substantially all of the plurality of cooling zones are positioned adjacent regions having highly efficient heat transfer properties of the wearer may further comprise positioning a vest over a torso of the wearer.

In some embodiments, the method further comprises reducing the wearer's body heat content through heat transfer from each region having highly efficient heat transfer properties to each cooling zone. The method may still further comprise reducing the wearer's body heat content by at least 0.3 degrees Celcius after 30 minutes of wear.

According to some embodiments, pre-cooling the article of wear comprises pre-cooling the article of wear at approximately 0° C. for two hours prior to wearing.

In some embodiments, the regions having highly efficient heat transfer properties comprise at least regions in an upper portion of a back and each forearm of the wearer.

BRIEF DESCRIPTION OF THE DRAWINGS

In the following detailed description, embodiments of the invention are described referring to the following Figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

According to certain embodiments, as illustrated in FIGS. 1A-9, the present invention comprises apparel, footwear, and accessories ("articles of wear 10") comprising at least one cooling zone 12. These cooling zones 12 contain cooling material, which is described in detail below.

In certain embodiments, as illustrated in FIGS. 1A-9, the articles of wear 10 are constructed using a base material 24, which may be a micromesh stretch material or other similar lightweight and flexible material. The base material 24 may serve as the base layer of the article of wear 10, to which the cooling zones 12 are attached.

The cooling zones 12 are attached on the base material 24 in locations where the cooling zones 12 will be positioned adjacent regions having highly efficient heat transfer properties of a wearer's body when worn.

Figure 3:
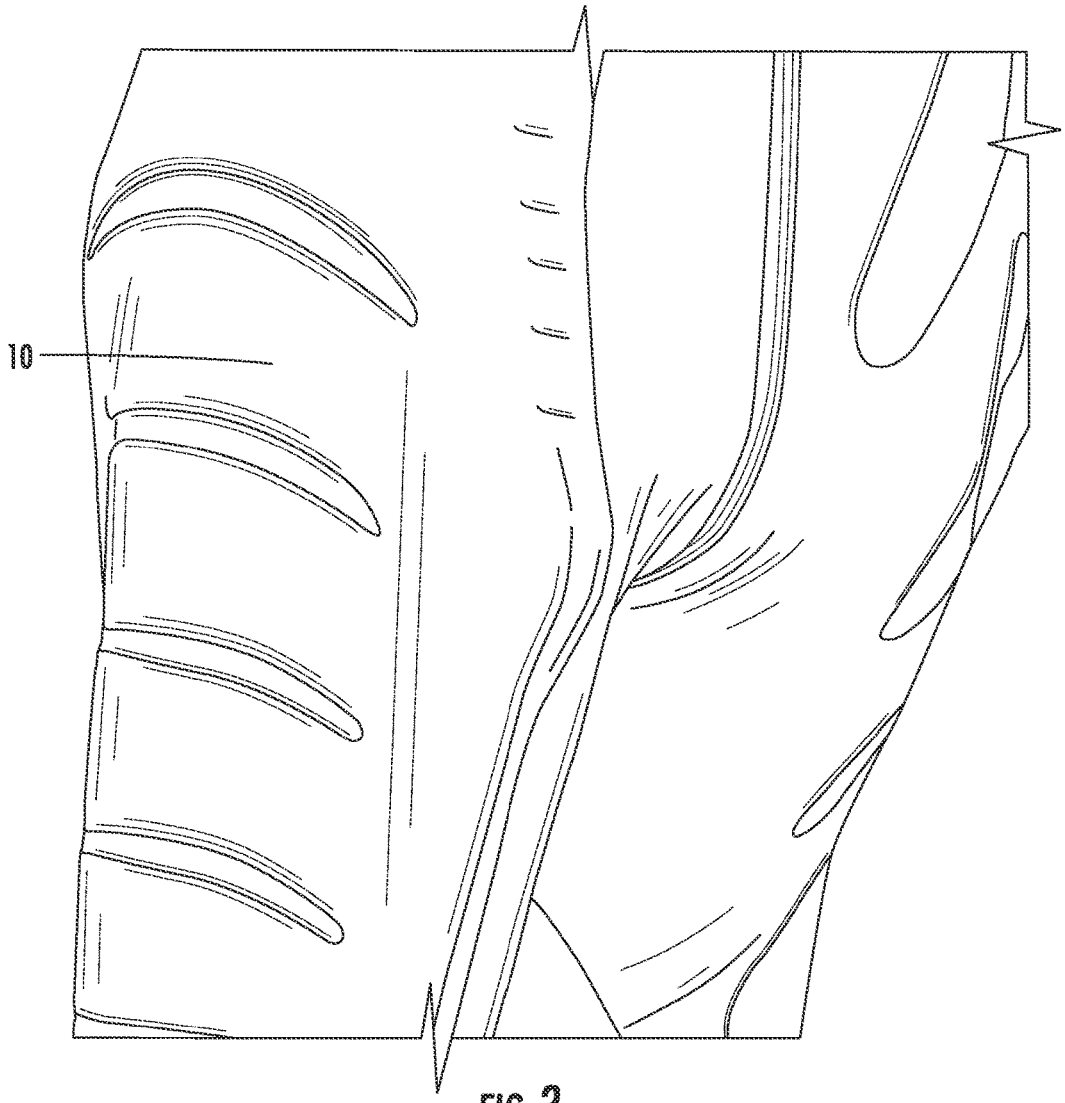
FIG. 3 is an image of a mix fabric, according to certain embodiments of the present invention.
Figure 4:
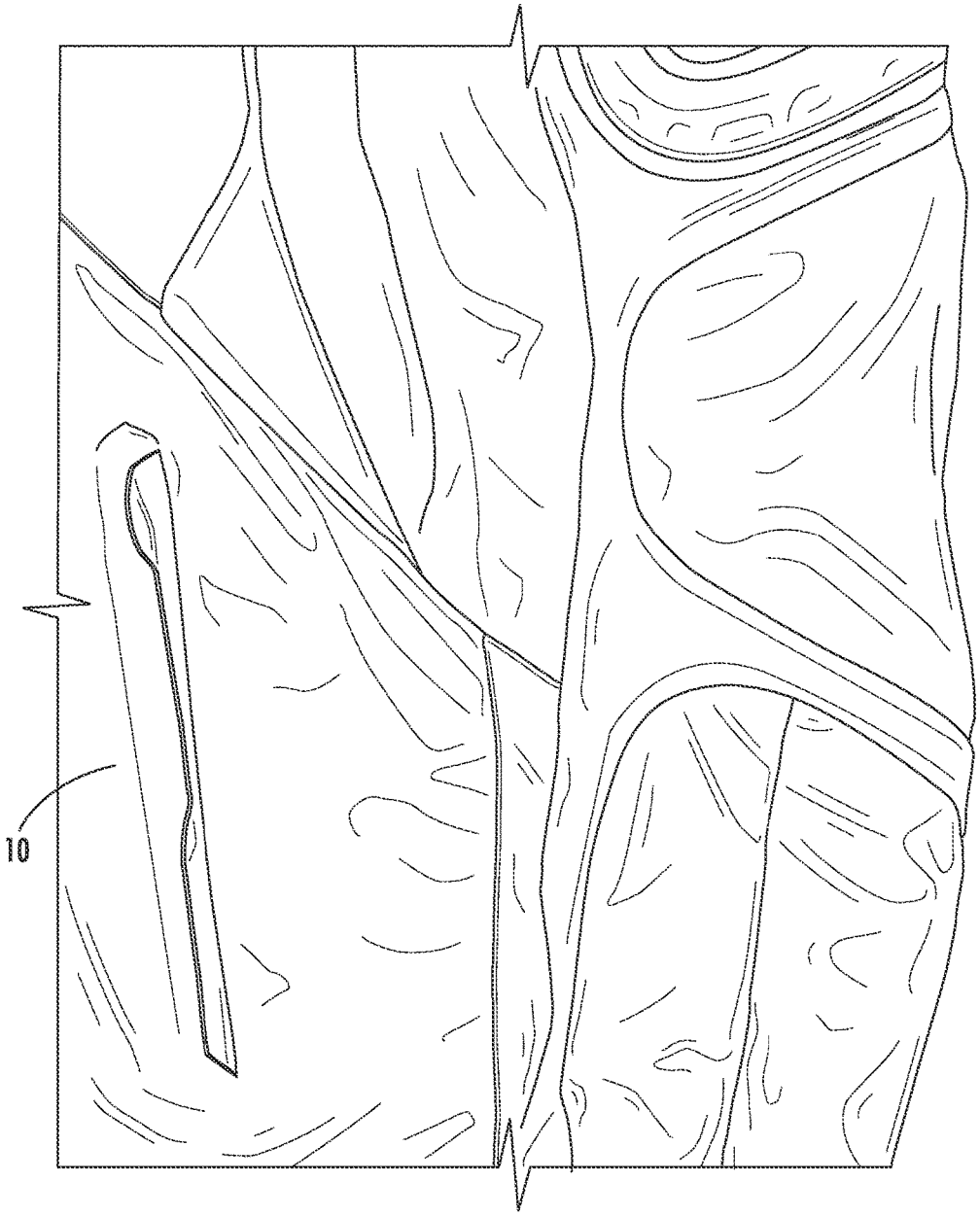
FIG. 4 is another image of a mix fabric, according to certain embodiments of the present invention.
Figure 5:
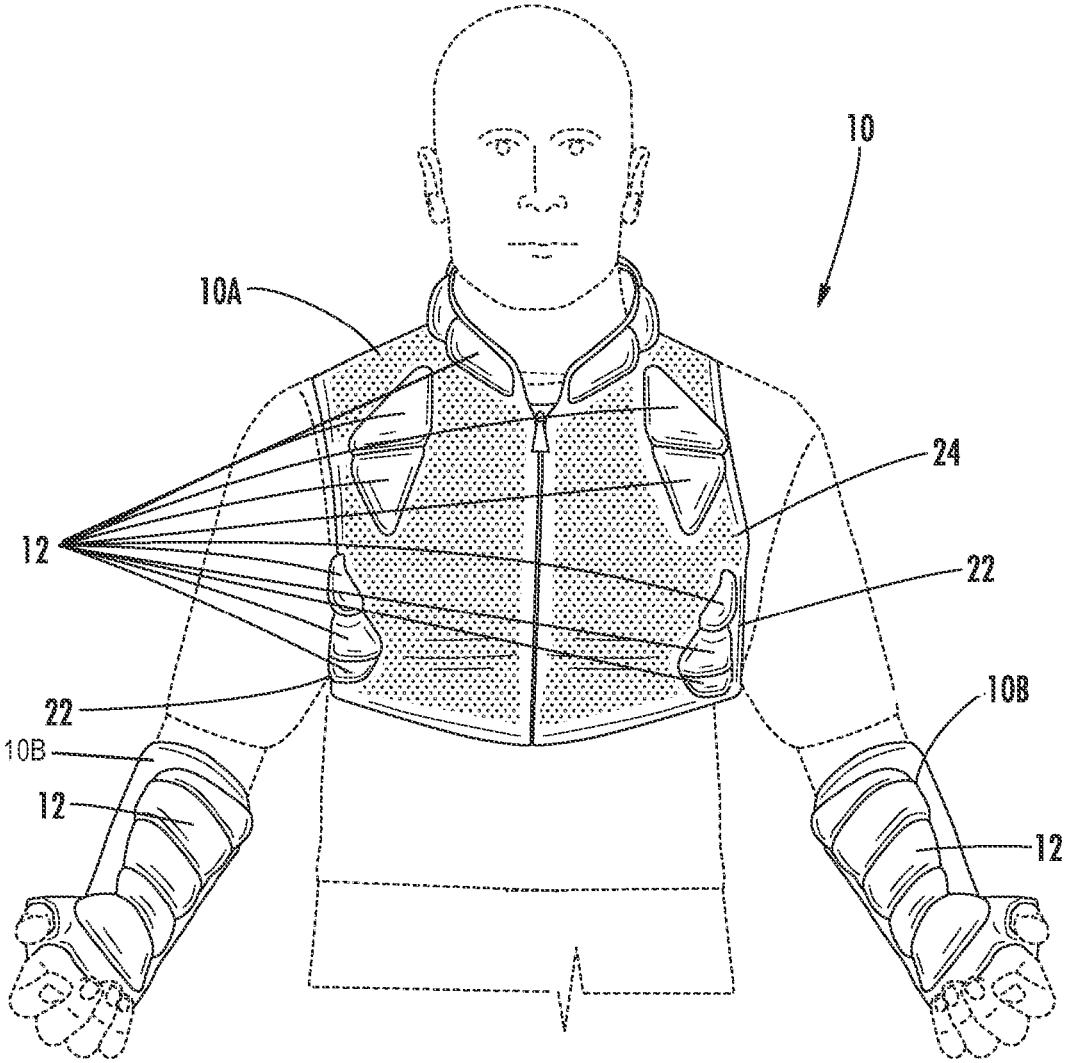
FIG. 5 is a front view of an article of wear comprising a vest and sleeves being worn by a wearer, according to certain embodiments of the present invention.
Figure 6A:
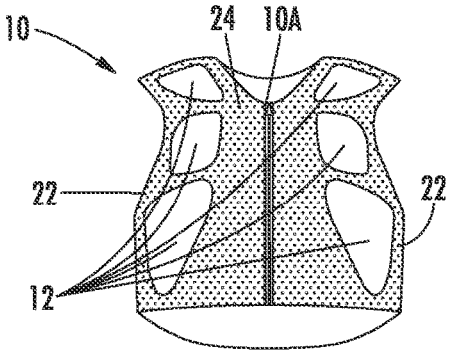
FIGS. 6A-6B are front and rear views, respectively, of an article of wear comprising a vest, according to certain embodiments of the present invention.
Figure 6B:
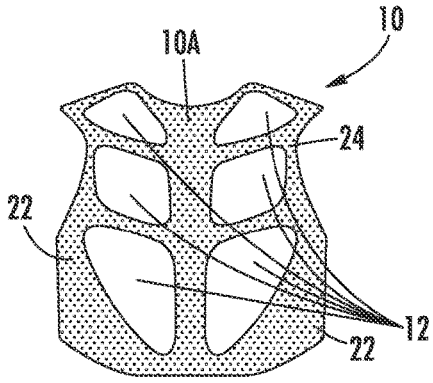
Figure 6C:
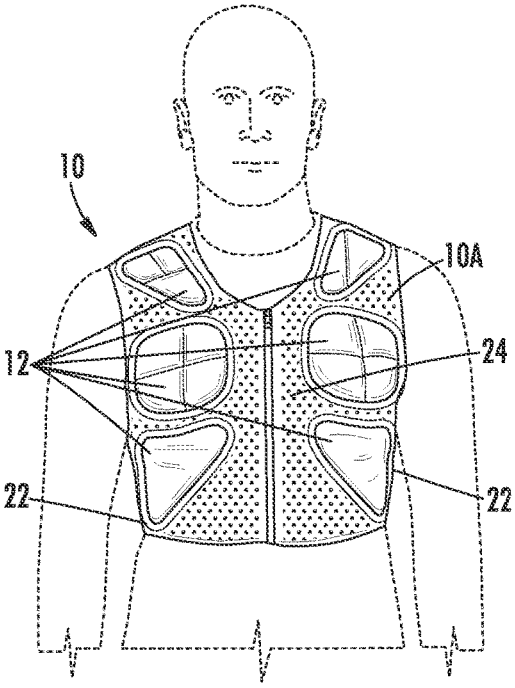
FIGS. 6C-6D are front and rear views, respectively, of the article of wear of FIGS. 6A-6B being worn by a wearer.
Figure 6D:
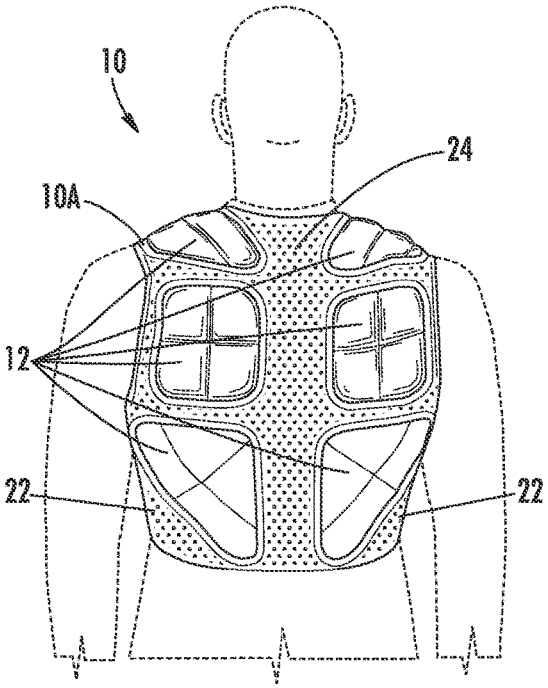

In certain embodiments, the cooling zones 12 comprise a microball pad system within which the cooling material is contained. In other embodiments, the cooling zone 12 may comprise a sealable pocket that allows the cooling material to be replenished and/or exchanged. The cooling zones 12 may be attached to the base material 24 via any suitable chemical or mechanical means including but not limited to welding, adhering, stitching, weaving, knitting, and injecting. FIGS. 3 and 4 illustrate examples of mix fabrics, wherein FIG. 3 shows bonding of different fabrics together along with some welded areas.

The cooling materials used in the cooling zones 12 may be selected based on a range of criteria, including but not limited to weight, cooling capacity, cooling duration, formability/flexibility, encapsulation, absorbency, and phase change temperature. For example, in certain embodiments, it may be desirable to have a cooling material that is a phase change material, which means that the cooling material is a solid at normal room temperature, but undergoes a phase change to a liquid when exposed to skin temperature of approximately 28° C. or above. The phase change material absorbs more energy than a temperature change of the cooling material within the same phase and does not require charging (or pre-cooling or freezing to a lower temperature) prior to use.

In other embodiments, the cooling material may be a super absorbent material that rapidly absorbs and retains large volumes of aqueous solutions when mixed with water or an aqueous solution, which converts the super absorbent material into a semi-solid, gelled state. Examples of such materials include but are not limited to sodium polyacrylate. Certain commercial embodiments may be found under the trade name AQUA Sorb® or may be distributed by Sigma-Aldrich.

A person of ordinary skill in the art will understand that any suitable material that is able to effectuate heat transfer from the desired regions of the wearer's body may be used and that more than one type of cooling material may be used in the cooling zones 12.

To achieve the most efficient use of the cooling zones 12, the cooling zones 12 are positioned adjacent discrete areas of the body that have highly efficient rates of transferring heat to or from the body, and may be specifically targeted to those areas by being configured not to contact areas of the body with less efficient rates of heat transfer. The next section describes the testing that was involved in identifying these targeted areas of the body. Based on these results, certain embodiments of the present invention are configured to have one or more cooling zones 12 positioned adjacent one or more primary regions 16, but may also include one or more additional cooling zones 12 positioned adjacent one or more secondary regions 18 and/or tertiary regions 20.

Figure 10:
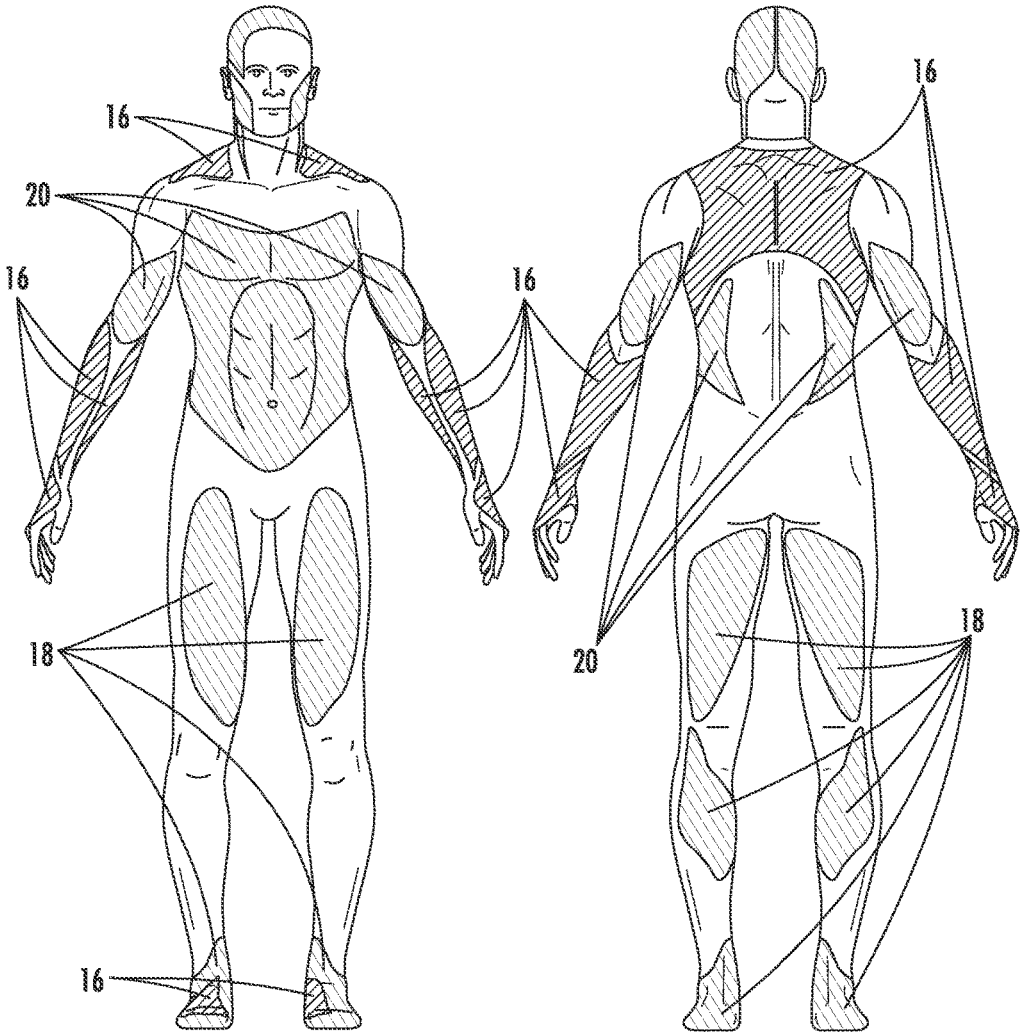
FIG. 10 shows primary, secondary, and tertiary regions of heat transfer on a human body.

As shown in FIG. 10 and Table 1, based on the results of the evaluation of the heat transfer properties of various areas of the body, the primary regions 16 may be located in the upper portion of the back and around the collar bone, the forearm, wrist, top of the hand, and top of the foot; secondary regions 18 may be located in the thighs, calves, and ankles; and tertiary regions 20 may be located in the upper arm and torso. However, a person of ordinary skill in the relevant art will understand that these are not exhaustive nor exclusive listings, and the categorization may change depending on the application and the body type.

Figure 1C:
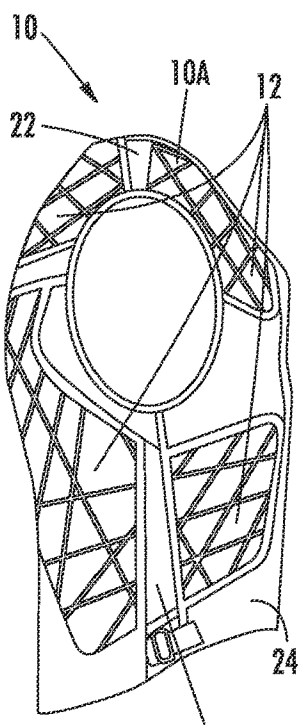
FIGS. 1A, 1B, and 1C are rear, front, and side views, respectively, of an article of wear comprising a vest, according to certain embodiments of the present invention.
Figure 1B:
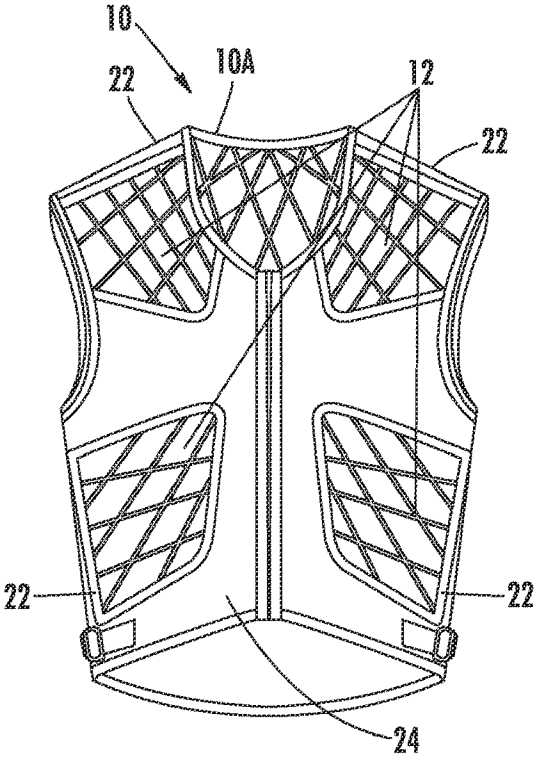
Figure 1A:
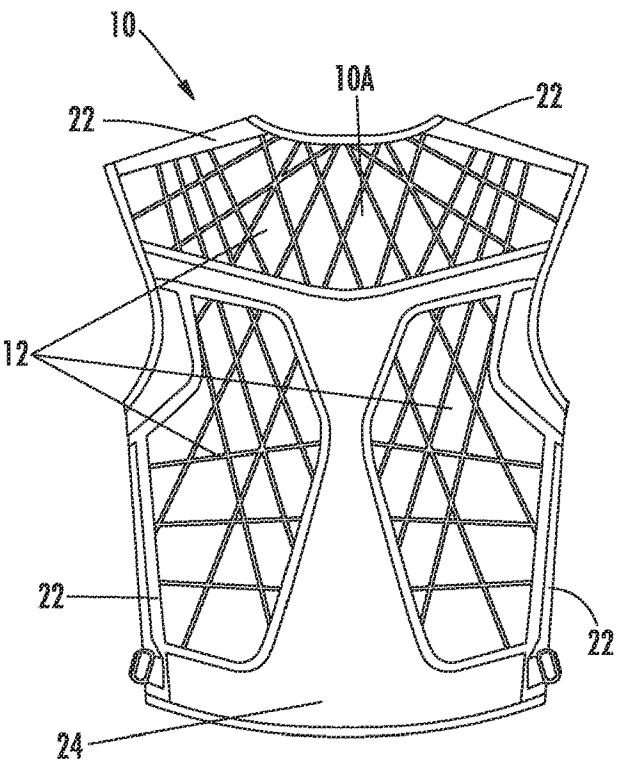
Figure 2C:
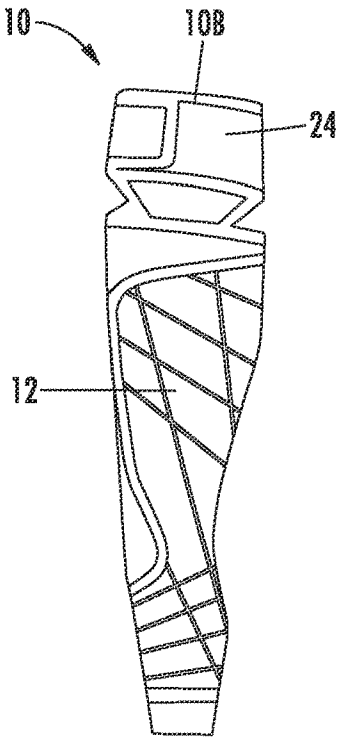
FIGS. 2A, 2B, and 2C are rear, front, and side views, respectively, of an article of wear comprising a sleeve, according to certain embodiments of the present invention.
Figure 2B:
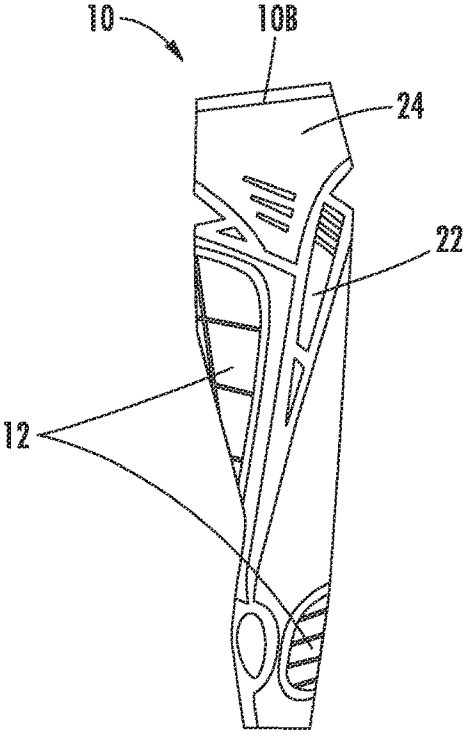
Figure 2A:
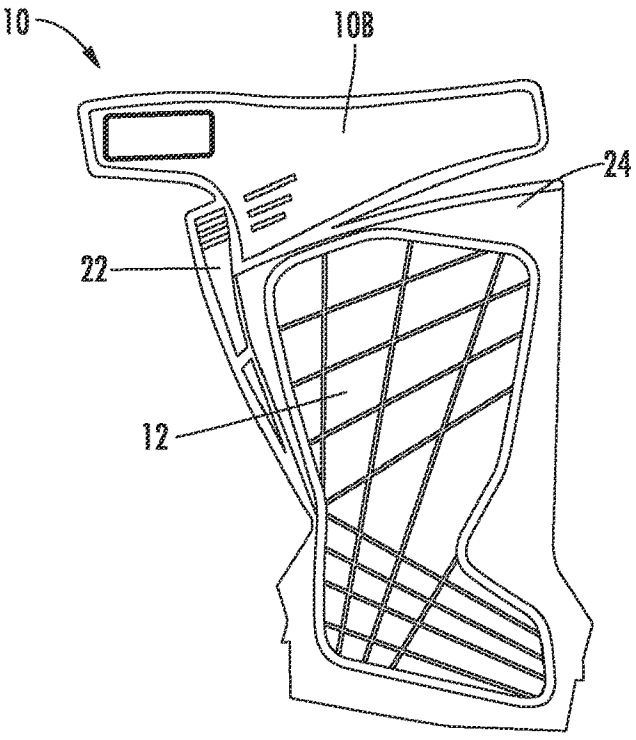

For example, in certain embodiments, as shown in FIGS. 1A-1C, the article of wear 10 is a vest 10A that is designed with cooling zones 12 configured to be positioned adjacent certain regions, such as the upper portion of the back, the collar bone, the sides of the back, and the rib cage of a wearer when worn. In some embodiments, as illustrated in FIGS. 2A-2C, the article of wear 10 is at least one sleeve 10B that is design with cooling zone 12 positioned adjacent a forearm and wrist of a wearer when worn. In other embodiments, the article of wear 10 may be any type of garment that is configured to provide cooling zones 12 in the desired regions of a wearer when worn, including but not limited to pants, shorts, shirts, camisoles, bras, slips, vest underwear, underwear, jackets, dresses, workout suits, tracksuits, coveralls, skirts, stockings, tights, leggings, suits, swimsuits, and tank tops.

In certain embodiments, as shown in FIGS. 5, 7A-7C, and 9, the article of wear 10 may comprise the vest 10A and a pair of sleeves 10B worn together. However, a person of ordinary skill in the relevant art will understand that the items 10A and 10B may also be worn individually (as shown in FIGS. 6A-6D and 8A-8C) or in any suitable sub-combination.

Figure 7C:
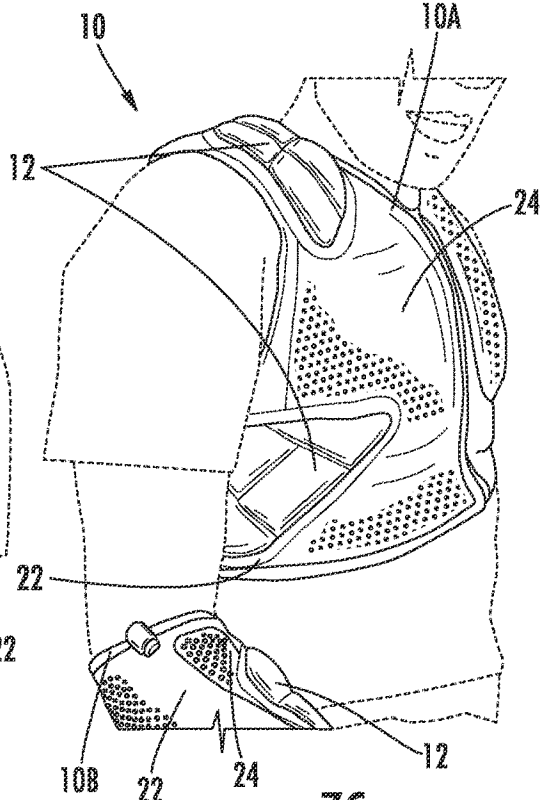
FIGS. 7A-7C are rear, rear perspective, and front perspective views, respectively, of an article of wear comprising a vest and sleeves being worn by a wearer, according to certain embodiments of the present invention.
Figure 7B:
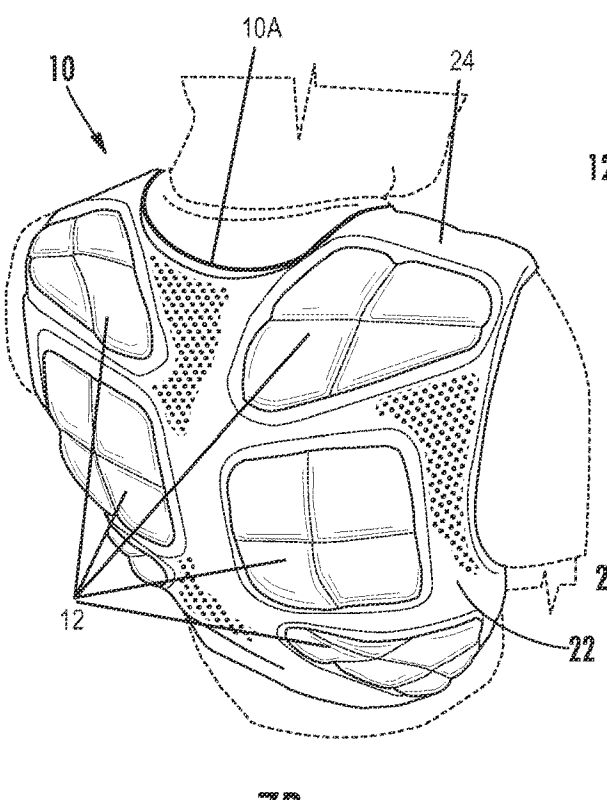
Figure 7A:
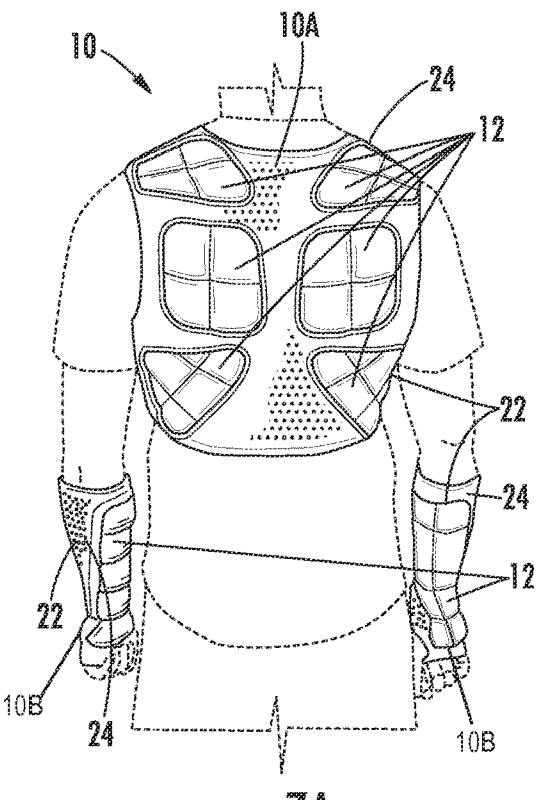

In the embodiments shown in FIGS. 1A-1C, 5, 6A-6D, 7A-7C, and 9, the cooling zones 12 of the vest 10A may be positioned adjacent the neck, upper pectoral region, rib cage, shoulder blades, and/or upper sides of the back of the wearer when worn. In some embodiments, as shown in FIGS. 6A-6D, the cooling zones 12 of the vest 10A may be adjusted so that some of the cooling zones 12 are positioned more on the shoulder and arm creases for wearing comfort, and/or where the front bottom cooling zones 12 are moved closer to the sides of the vest 10A. Furthermore, in some embodiments, as shown in FIGS. 6A-6D, the back top and back middle cooling zones 12 may be positioned closer to the center of the back of the wearer when worn. In certain additional embodiments, as shown in FIGS. 7A-7B, larger cooling zones 12 may be included on the back of the vest 10A.

Figure 8C:
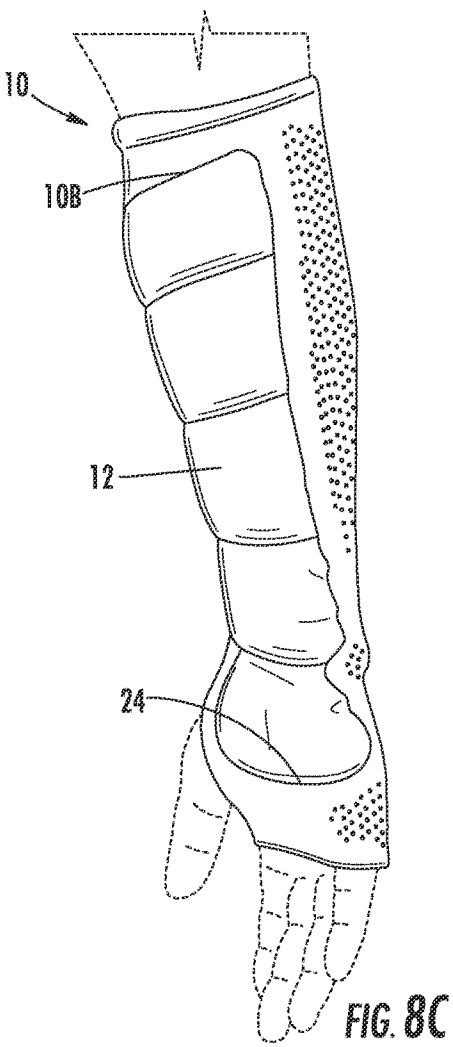
FIGS. 8A-8C are top, bottom, and side views, respectively, of the sleeve of FIGS. 7A-7C.
Figure 8B:
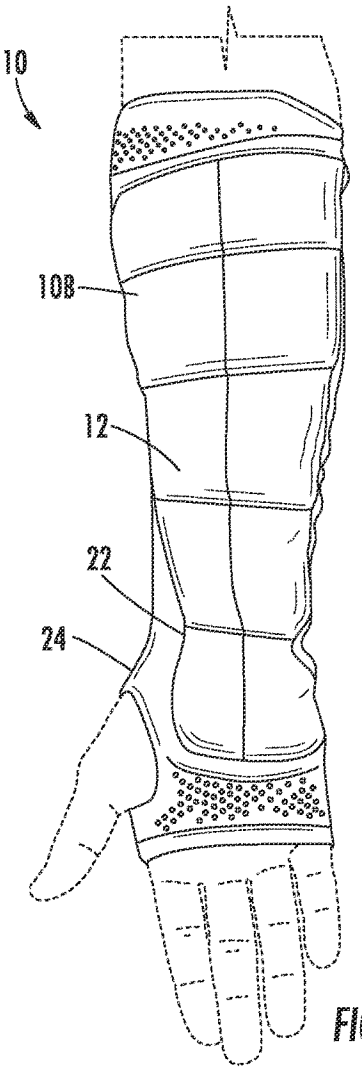
Figure 8A:
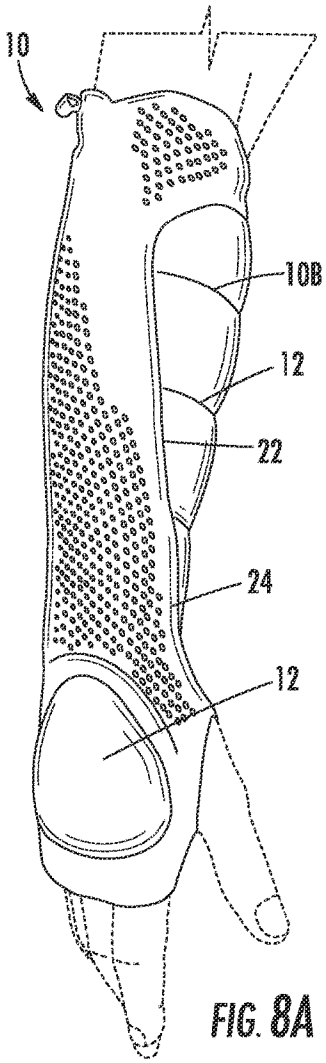
Figure 9:
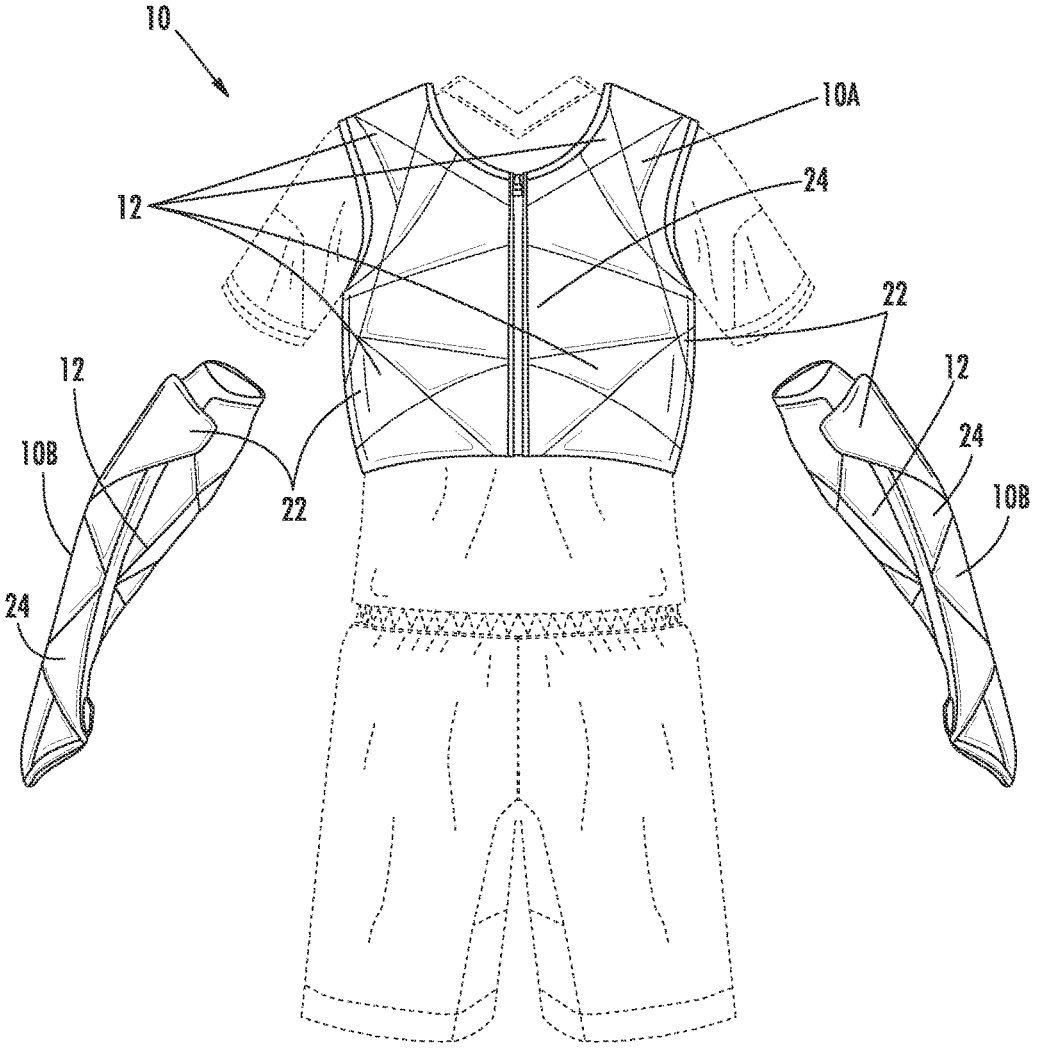
FIG. 9 is a front view of an article of wear comprising a vest and sleeves being worn by a wearer, according to certain embodiments of the present invention.

In the embodiments shown in FIGS. 2A-2C, 5, 7A-7C, 8A-8C, and 9, the cooling zones 12 of the sleeves 10B may be positioned adjacent the inner forearms of the wearer when worn. In some embodiments, as shown in FIGS. 8A-8C, the cooling zones 12 of the sleeves 10B may be adjusted so that the cooling zones 12 extend closer to the middle of the arm and elbow so as to cover more muscle. Also, as illustrated in FIGS. 2A-2C, an opening and closure on top of the sleeve may be included to increase flexibility in sizes.

In certain embodiments, the vest 10A and/or the sleeves 10B may include at least one stretch region 22 that is configured to provide a snug fit to the wearer when worn. The stretch region 22 may be formed of any suitable elastane material alone or in combination (such as lycra as one exemplary material) or any other suitable material having the desired amount of elasticity or may be achieved through appropriate fabric construction. The stretch region 22 may be inserted between and coupled to panels of the base material 24. The stretch region 22 may also be the same material used for the cooling zones 12 and/or the base material 24. Furthermore, in certain embodiments, the fabric used in the stretch regions 22 may be the same material that is used over the article of wear 10.

In the embodiments shown in FIGS. 1A-1C, 2A-2C, and 5, the stretch regions 22 are positioned on the sides of the vest 10A and on the sides of the sleeves 10B. In the embodiments shown in FIGS. 6A-6D 7A-7C, and 9, the stretch region 22 may be positioned in the vest 10A closer to the back of the wearer when worn. In the embodiments shown in FIGS. 8A-8C, the stretch region 22 may be relocated on the sleeve 10B to allow for the inclusion of additional cooling zones 12 and/or may also be configured as a V insert to help reduce potential twisting that may occur when the arm is changing from front to back. The fabric used in the stretch regions 22 may be the same material that is used over the article of wear 10.

Evaluation of Differences in Heat Exchange Among Anatomical Regions

To map each individual anatomical section of the body in terms of differing rates of heat loss, a protocol was performed, wherein the subject was subjected to 10 minutes of thermal stabilization in a water bath of 32° C., followed by 11 cycles of 5 minutes of cooling at 10° C., followed by 5 minutes of warming at 33° C.

Table I summarizes the mean heat flux for the different body zones. The surface is the area of each zone, the length corresponds to the length of tubing within a given zone, external tubing corresponds to the length of tubing that is open to the environment between the suit and the heater, the internal suit tubing is the total length of tubing within each zone, ΔT is the change in inlet versus outlet water temperature, and mean heat loss is the cooling power of each zone.

TABLE 1

Mean Heat Flux For Different Body Zones

| Conditions | Surface area ($m^2$) | External Tubing (m) | Internal Tubing (m) | Mean Flow Rate (mL · min*) | Mean ΔT (° C.) | Uncorrected Mean Heat loss ($W \cdot m^{-2}$) | Corrected Mean Heat Loss ($W \cdot m^{-2}$) |
|---|---|---|---|---|---|---|---|
| 1. Head | 0.099 | 3.70 | 7.45 | 279.4 ± 61.7 | 2.4 ± 0.2 | 528.9 ± 49.4 | 327 ± 87.3***, |
| 2. Tersa | 0.210 | 3.60 | 18.65 | 280.5 ± 33.4 | 4.1 ± 1.6 | 435.1 ± 176.1 | 357.2 ± 184.9 |
| 3. Upper Back | 0.124 | 3.56 | 10.39 | 279.5 ± 56.2 | 4.4 ± 0.4 | 721.9 ± 87.1 | 534.8 ± 132.9*** |
| 4. Lower Back | 0.110 | 3.62 | 9.20 | 289.0 ± 31.4 | 2.1 ± 0.7 | 452.4 ± 231.0 | 295.7 ± 249.5 |
| 5. Upper Arm | 0.180 | 3.82 | 13.06 | 287.0 ± 31.3 | 4.8 ± 1.2 | 601.5 ± 198.7 | 498.1 ± 220.5 |
| 6. Forearm | 0.106 | 3.67 | 8.58 | 387.0 ± 31.3 | 4.7 ± 0.9 | 960.6 ± 215.9 | 789.6 ± 235.6*** |
| 7. Hands | 0.084 | 3.91 | 3.08 | 384.5 ± 47.3 | 4.7 ± 0.3 | 1173.3 ± 75.8 | 876.1 ± 131.4***, |
| 8. Front Thigh | 0.234 | 3.85 | 17.77 | 280.0 ± 46.4 | 7.8 ± 0.8 | 723.0 ± 83.0 | 636.7 ± 89.5*, |
| 9. Rear Thigh | 0.116 | 3.86 | 10.33 | 280.0 ± 46.43 | 4.2 ± 1.7 | 813.5 ± 355.5 | 603.9 ± 372.5** |
| 10. Lower Leg | 0.188 | 3.71 | 9.50 | 279.0 ± 56.3 | 5.6 ± 0.8 | 591.3 ± 129.4 | 499.4 ± 126.8 |
| 11. Foot | 0.135 | 3.93 | 11.91 | 287.5 ± 31.7 | 5.6 ± 0.6 | 906.4 ± 173.7 | 751.1 ± 197.1* |
| Total | 1.576 | 41.23 | 121.93 | 283.0 ± 43.0 | 4.6 ± 0.9 | 718.8 ± 160.4 | 560.9 ± 183.5 |

*= $p < 0.05$;

**= $p < 0.01$,

***= $p < 0.0005$ between corrected and uncorrected values.

Superscript denoted significant difference compared to numbered zone ($p < 0.05$)

Figure 11:
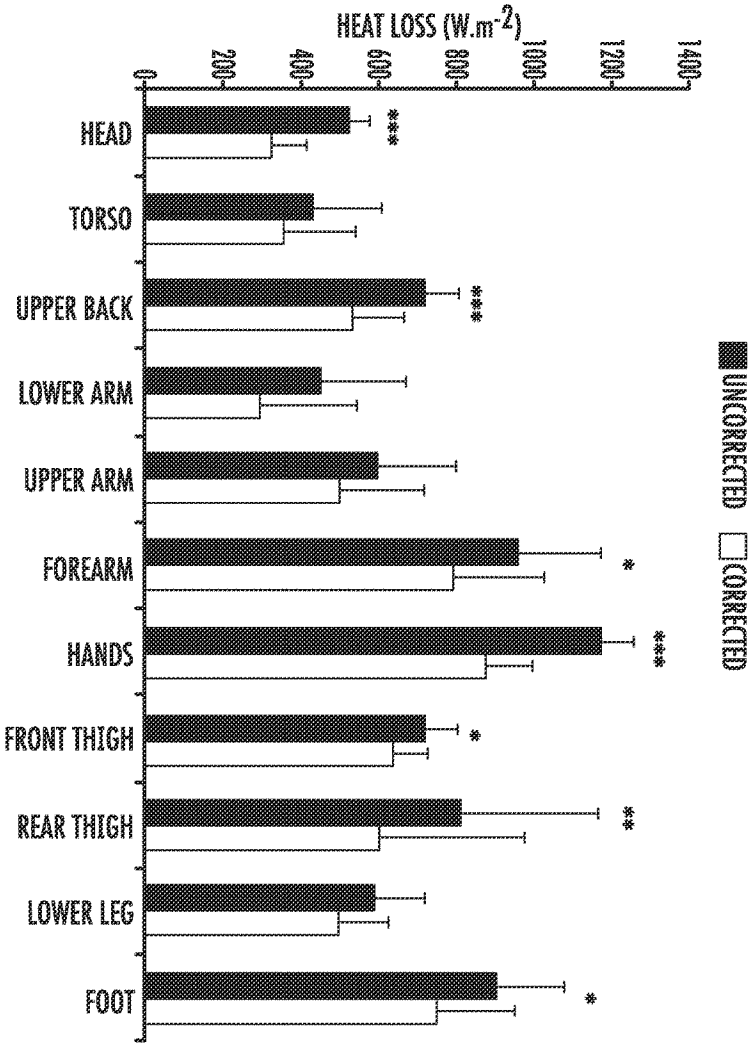
FIG. 11 is a graph showing heat loss for various primary, secondary, and tertiary regions.

As shown in FIG. 11 and Table I, there is significant variation among anatomical regions of the neck, forearm, hands, and upper back and their respective rates of heat exchange. The results demonstrate that regions with the highest heat exchange and greatest drop in temperatures are also areas with little subcutaneous fat deposition and a high density of blood vessels close to the skin surface.

Figure 12:
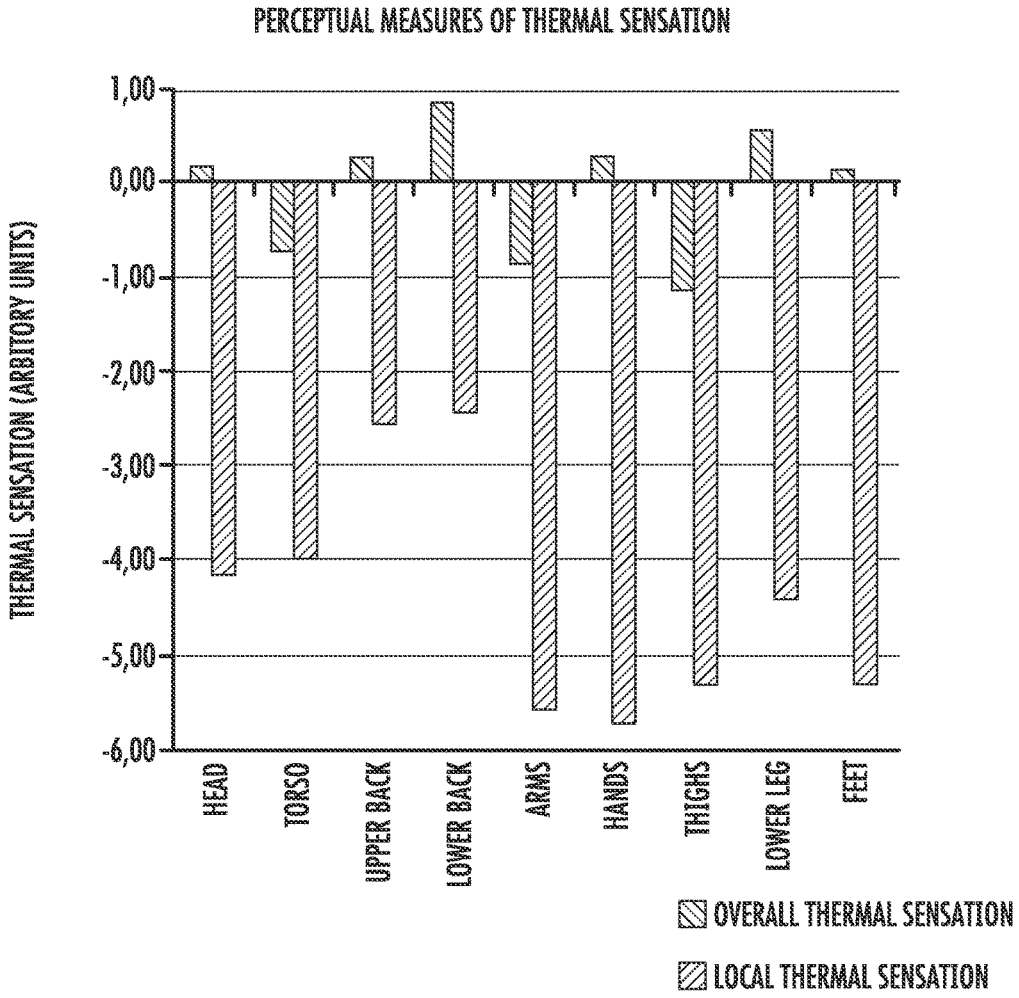
FIG. 12 is a graph showing perceptual measures of thermal sensation for various primary, secondary, and tertiary regions.

In addition, as shown in FIG. 12, different regions are more sensitive to changes in temperature, which may influence overall thermal comfort. For example, selecting a zone that reduces overall thermal sensation may have a positive effect on performance. These results support the hypothesis that the manipulation of temperature at the extremities may result in faster rates of heat gain/loss then when cooling/heating is applied in other, more conventional regions, such as the torso. As a result, the areas that may be targeted for effective heat exchange as the primary regions 16 are the extremities and the upper portion of the back.

Studies were then performed to evaluate the effects of different temperatures of pre-cooling applications to the hands, forearms, and torso regarding cycling time trial performance in the heat. The details of this evaluation are described below.

Evaluation of Different Temperatures of Pre-Cooling Application to the Hands, Forearms, and Torso Lowers on Skin Temperature and Cycling Time Trial Performance in the Heat Participants Ten endurance trained competitive male cyclists and triathletes (25.1±6.1 yrs; height 178.9±6.1 cm; weight 72.5±5.1 kg; $VO_2$ max 61.3±4.3 mL/kg/min; body fat 7.2±2.9% body fat) who were familiar with the type of testing involved were recruited for this study. All participants were required to be free from injury and have a $VO_2$ max in excess of 55 mL/kg/min. The Loughborough University ethical advisory committee approved all experimental procedures. Participants gave their full written informed consent.

Experimental Design

Participants visited the laboratory on a total of 5 occasions. Visit 1 consisted of body composition measurement and an incremental exercise test to exhaustion to determine $VO_2$ max and maximal power output (W.). Visits 2, 3, 4 and 5 were simulated cycling time trials in which participants were instructed to complete a set amount of work in as short a time as possible. Visit 2 served as a familiarization trial to ensure that participants were able to complete the required exercise and to minimize any potential learning effect on time trial performance. Visits 3, 4 and 5 constituted the experimental visits where participants underwent i) cold pre-cooling using a cooling garment frozen overnight (COLD), ii) moderate pre-cooling where the cooling garments were saturated in cool water for 30 minutes prior to wearing (COOL); or iii) control where no pre-cooling was implemented prior to the start of the time trial (CONT). Trials were conducted in a randomized and counterbalanced order, with each visit separated by a minimum of 7 days to minimize acclimation effects.

Visit 1

Participants first had their height (Seca, Birmingham, UK) and weight (ID1 Multi Range, Sartorius, Goettingen, Del.) recorded. Body composition was calculated using skinfold calipers (Harpenden, HaB Intl Ltd, Warwickshire, UK) using the 7 site skinfold method as described by Jackson and Pollock and weighted for the athletic population (Jackson et al., *Generalized Equations for Predicting Body Density of Men*, The British Journal of Nutrition, 1978: 40: 497-504). The $VO_2$ max test was conducted on an electronically braked cycle ergometer (Lode Excalibur Sport, Groningen, The Netherlands), and consisted of 3 minutes at 95 W, followed by 35 W increments every 3 minutes until the participant reached volitional fatigue.

Visits 3-5

Participants reported to the laboratory in the morning (0600-0900) following an overnight fast and having abstained from caffeine and alcohol ingestion or any strenuous exercise in the preceding 24 hours. Each participant completed their trials at the same time of day to minimize the effects of circadian variation on exercise performance.

Prior to each experimental visit, participants were given an ingestible temperature pill (VitalSense, Mini Mitter, Oreg.) and instructed to take it 8-10 hours prior to reporting to the laboratory. On arrival, the pill was located using a receiver to confirm that it was functioning correctly. Participants then had their nude weight recorded (ID1 Sartorius, Goettingen, Del.). They were then instrumented with wireless temperature sensors (iButton, DS1922, Sunnyvale, Calif.) that were secured in place using Medipore tape (3M, Berkshire, UK). The locations of the iButtons were forehead, scapula, right bicep, left pectoral, left forearm, left hand, right thigh and left calf, to allow for the subsequent calculation on mean skin temperature (ISO 9886 1992). The iButtons recorded at 60 s intervals throughout the duration of each trial. Heart rate was monitored and recorded throughout the trials (RS800, Polar, Fi). In order to minimize differences in clothing insulation, all participants wore a standard athletic shirt during the stabilization, cooling, and warm up periods. This was removed on completion of the warm up.

Figure 13:
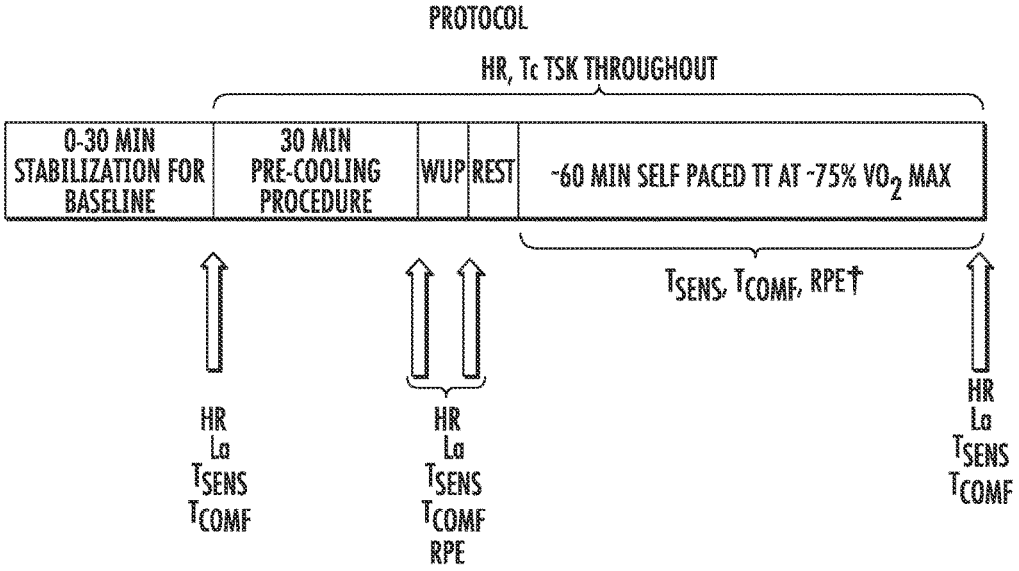
FIG. 13 is a diagram illustrating the protocol used to evaluate difference temperatures of pre-cooling application to the hands, forearms, and torso lowers on skin temperature and cycling time trial performance in the heat.

The protocol for the testing is illustrated in FIG. 13. Following instrumentation, participants remained in a space at room temperature (21.2±0.8° C.) prior to the collection of baseline measures after 30 minutes. Participants were then moved to an environmental chamber maintained at 35.0±0.4° C. and 50.6±1.3% relative humidity, where they donned the cooling garments for the experimental conditions or remained seated in cycling clothing for a further 30 minutes. On completion of the precooling phase, participants then mounted the cycle ergometer to complete a standardized 9-minute warm up which consisted of 3 minutes stages of 150 W, 200 W, and 250 W. If worn, the cooling garments were removed on completion of the warm up and participants had 5 minutes to stretch and prepare for the start of the time trial.

For the time trial, participants were given a set amount of work, equivalent to cycling for 1 hour at 75% $W_{max}$ (912.7±131.3 kJ) to complete in as fast a time as possible. The ergometer was set in linear mode so that 75% $W_{max}$ was obtained when participants cycled at their preferred cadence. Participants exercised separately with no performance feedback other than the accumulated work done, target workload and a graphical representation of fluctuations in power output. They had minimal interaction with the investigators. This type of time trial procedure has been shown to be highly reproducible when performed in this way and with participants experienced in this type of exercise. Jeukendrup A., Saris W. H., Brouns F., and Kester A. D., *A New Validated Endurance Performance Test*, Med. Sci. Sports Exerc. 1996: 28: 266-270.

During the time trial, participants were allowed to drink water ad libitum, with the total volume consumed recorded to allow for sweat rate calculation. Water was kept at the same temperature as the surrounding environment. At 10% intervals of total work done, core temperature ("Tc") was recorded. At 20% intervals, RPE (Borg G. A., *Psychophysical Bases of Perceived Exertion*, Med. Sci. Sports Exerc. 1982: 14: 377-381), thermal sensation (ASHRAE, *Thermal Comfort, ASHRAE Handbook of Fundamentals*. 1997: 8.1-8.26) and thermal comfort (Griffiths I. D. and Boyce P. R., *Performance and Thermal Comfort*, Ergonomics 1971: 14: 457-468) were recorded. 20% intervals were chosen to minimize participant/investigator interaction.

Cooling Garments

The vest and sleeves were constructed of a breathable mesh fabric, and pockets of hydrophilic silica gel. The vest had gel "packs" located on the left and right hand side of the upper pectorals and above the oblique abdominal region. On the posterior side, there was a pack located over the upper trapezius region that extended across the width of the shoulders. There were also packs running vertically above the latissimus dorsi region of the back, lateral to the spine on either side. Each sleeve was made of a tube of fabric with a thumb loop to ensure optimal fit and stability. The main gel pack on each sleeve covered the majority of the anterior and posterior forearm and the palm of the hand. Additionally there was a small pack on the dorsal side of the hand.

Calculations

Mean Body Temperature:

Mean body temperature ($\overline{T}_b$) was calculated using the following formula based on weighted values for $T_c$ and $\overline{T}_{sk}$ (Hardy J. D. and Dubois E. F., *Basal Metabolism, Radiation, Convection and Vaporisation at Temperatures of* 22 *to* 35°; J. Nutr. 1938: 1: 477-49; Vallerand A. L., Savourey G., Hanniquet A. M., and Bittel J. H., *How should Body Heat Storage be Determined in Humans: By Thermometry Or Calorimetry?, Eur. J. Appl. Physiol. Occup. Physiol.* 1992: 65: 286-294):

$$\overline{T}_b=(0.8*T_c)+(0.2*\overline{T}_{sk})$$

Mean Skin Temperature:

Mean skin temperature ($\overline{T}_{sk}$) was calculated using an area weighted 8-site calculation (ISO 9886 1992) using the following formula:

$$\overline{T}_{sk}=(0.07*T_{head})+(0.175*T_{scap})+(0.175*T_{chest})+(0.07*T_{bicep})+(0.07*T_{forearm})+(0.05*T_{hand})+(0.19*T_{thigh})+(0.2*T_{calf})$$

Mean Body Heat Content:

Mean body heat content ($H_b$) was calculated using the following formula:

$$H_b=\overline{T}_b*(w*C)$$

Where w equals participant's weight (kg) and C is equal to the specific heat of body tissue (3.49 $J\cdot g^{-1}\cdot{}^{\circ}C.^{-1}$).

Statistics

Means and standard deviations were calculated. A repeated measures analysis of variance (ANOVA) was used to determine differences between conditions over time. Where significant differences were identified, post-hoc pairwise comparisons with a Bonferonni correction were conducted. Effect sizes we calculated for time trial completion times, with effect sizes of <0.2 classified as small, 0.4-0.6 as medium and >0.8 as large (Cohen J. W., *Statistical Power Analysis for the Behavioural Sciences*, Lawrence Erlbaum Associates 1988). The accepted level of significance was $p<0.05$. All data are presented as mean±SD unless otherwise stated.

Results

Time Trial Performance

Figure 14:
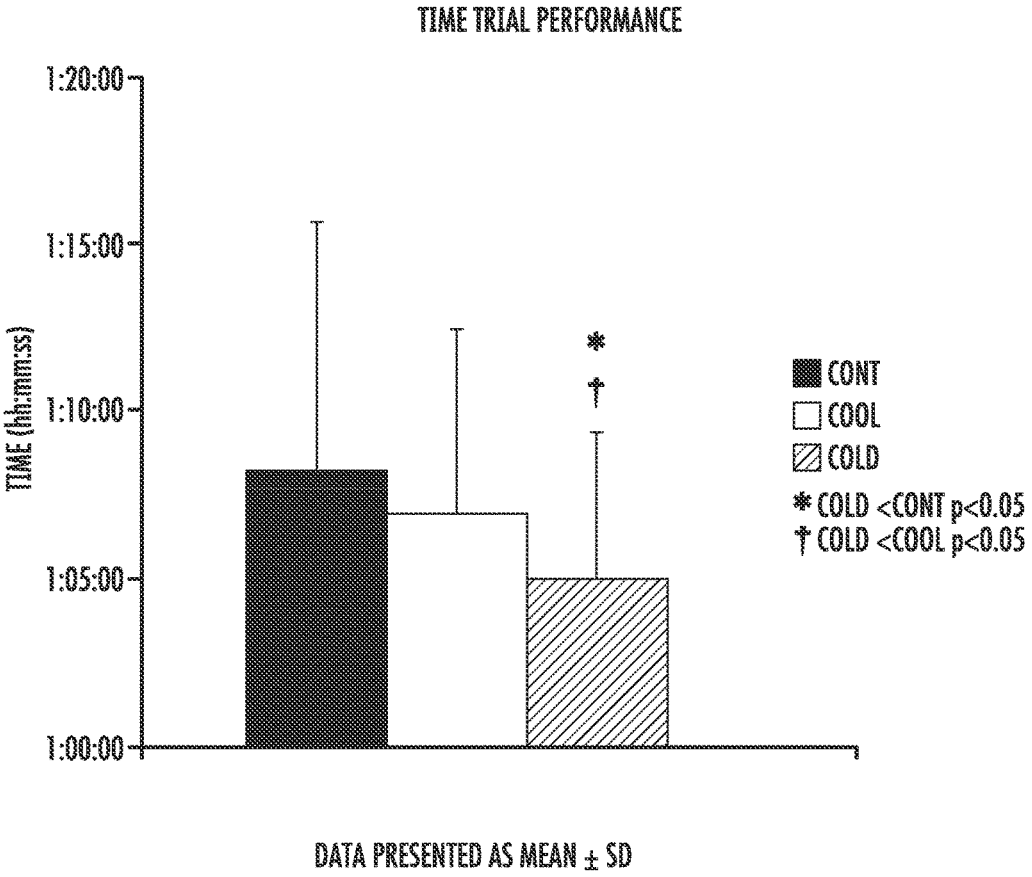
FIG. 14 is a graph showing the time trial performance achieved for each temperature of pre-cooling application.

As illustrated in FIG. 14, time to complete the time trial was significantly faster following COLD ($p<0.05$; FIG. 14), which equated to an improvement of 195±170 s, or 4.8% and a medium strength effect size (Cohen's d=0.6). In addition COLD was faster than COOL (2.9%, d=0.4, $p<0.05$). There were no significant differences at any of the individual time points between conditions.

Power Output

Figure 15:
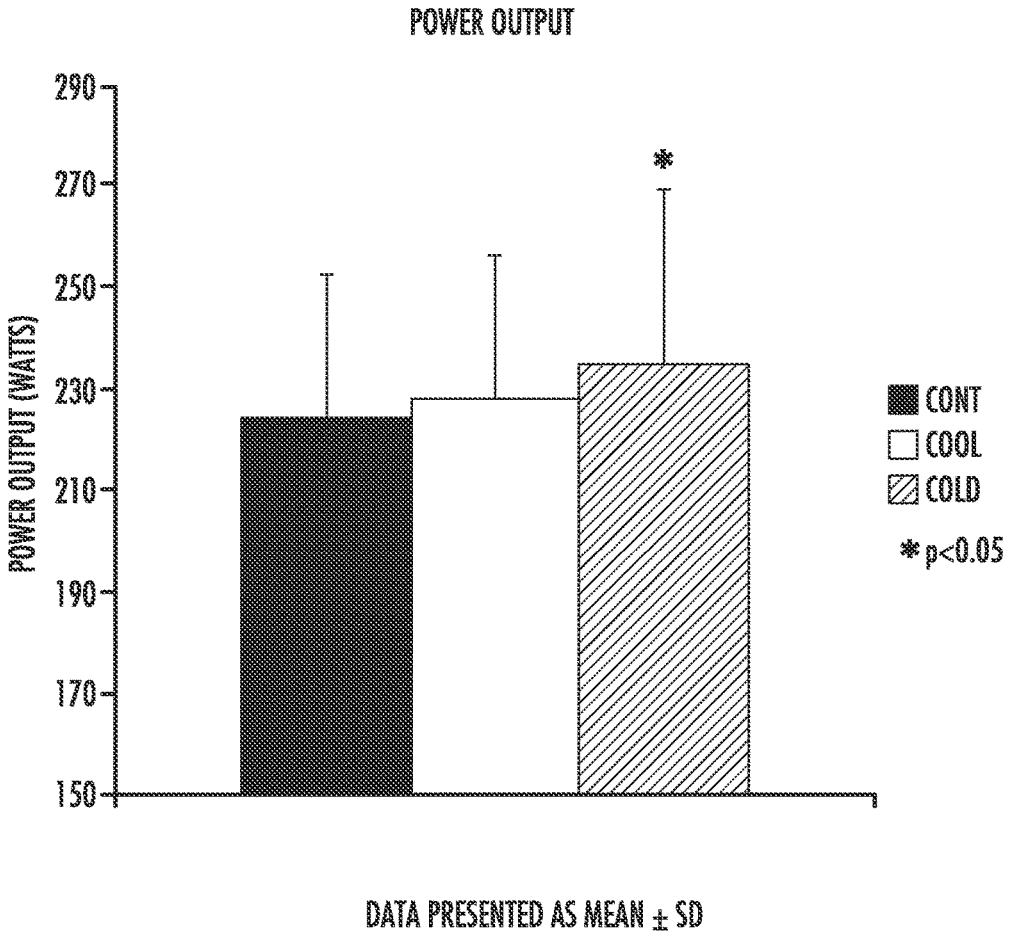
FIG. 15 is a graph showing the power output achieved for each temperature of pre-cooling application.

As illustrated in FIG. 15, pre-cooling increased mean power output throughout the course of the time trial for COLD, with no effect of COOL compared to when no pre-cooling was used. As a result, mean power output was higher for COLD (234.4±33.8 W) vs. COOL (227.1±25.7 W; $p<0.05$, FIG. 15). This equates to a 10.0±8.4 W or 4.5% improvement in mean power output for COLD compared to CONT.

Mean Skin Temperature

Figure 16:
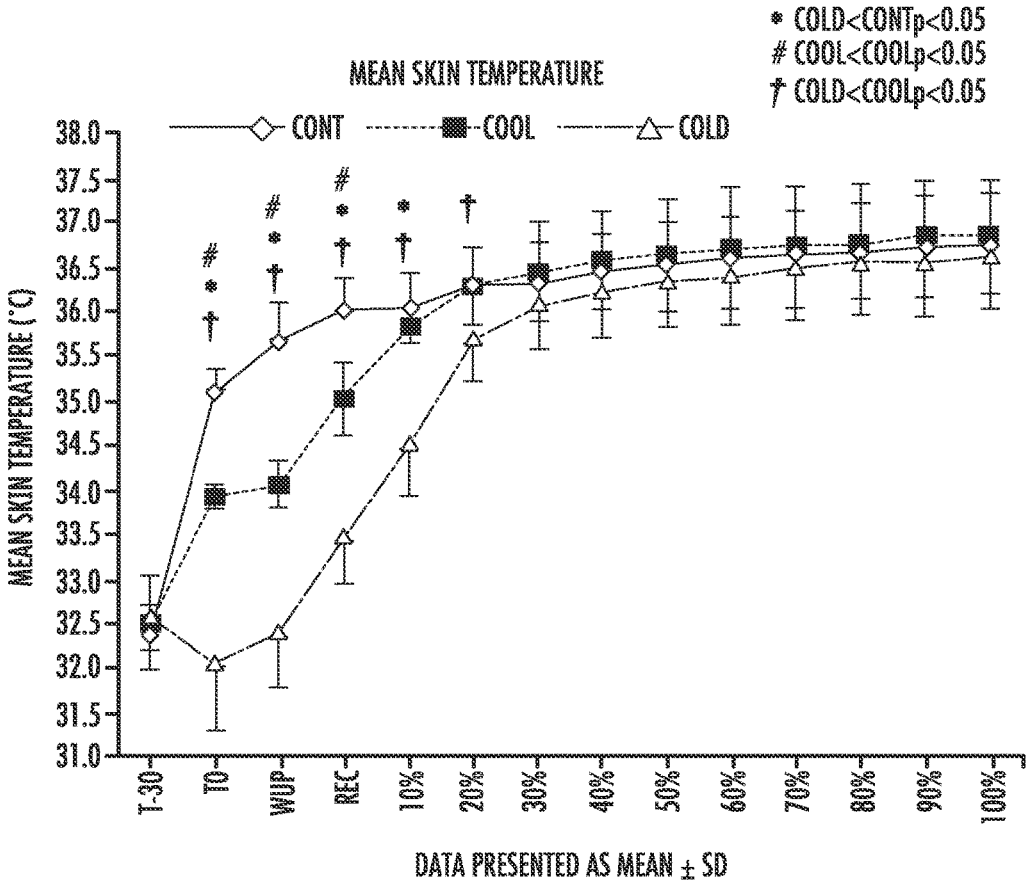
FIG. 16 is a graph showing mean skin temperature changes for each temperature of pre-cooling application.

As illustrated in FIG. 16, there were significant effects of both pre-cooling application ($p<0.05$) and time ($p<0.05$) on mean skin temperature. There was a significant interaction for condition and time on $\overline{T}_{sk}$ ($p<0.05$). Mean skin temperature was significantly lower for both COOL and COLD when compared to CONT at T0 (both $p<0.05$). This effect lasted between 10% (COOL) to 20% (COLD) of the target workload.

Mean Body Temperature

There were significant effects of both condition ($p<0.05$) and time ($p<0.05$) on mean body temperature following pre-cooling. For example, the reduction in mean body temperature lasted until the start of the time trial for COOL ($p<0.05$) and 20% for COLD (37.2±0.4° C., $p<0.05$). At the onset of the time trial, mean body temperature was lower for COLD vs. CONT (36.1±0.3 vs. 37.0±0.3° C. $p<0.05$) and for COOL vs. CONT (36.5±0.6 vs. 37.0±0.3° C., $p<0.05$).

ΔBody Heat Content

Figure 17:
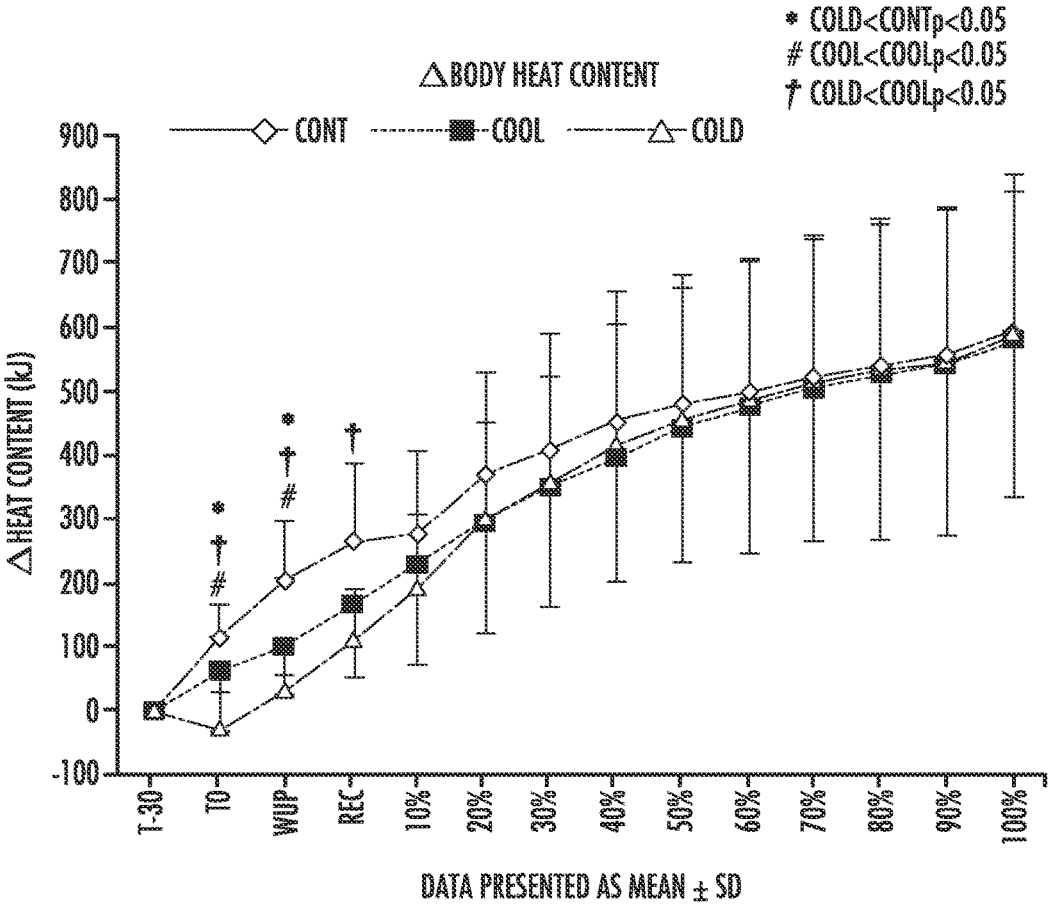
FIG. 17 is a graph showing body heat content changes for each temperature of pre-cooling application.

As illustrated in FIG. 17, with a core to skin temperature weighting of 0.8/0.2, the change in body temperature following pre-cooling, the warm up and the first 10% of the performance trial was lower for COLD vs. CONT ($p<0.05$) and approached significance for both COOL vs. CONT ($p=0.09$) and COOL vs. COLD ($p=0.07$). Between T0 and REC COOL<CONT ($p<0.05$) and COLD<CONT ($p<0.05$) and COLD<COOL ($p<0.05$). At 10% into the performance trial COLD<COOL ($p<0.05$, FIG. 17).

Heart Rate and Core Temperature

Figure 18:
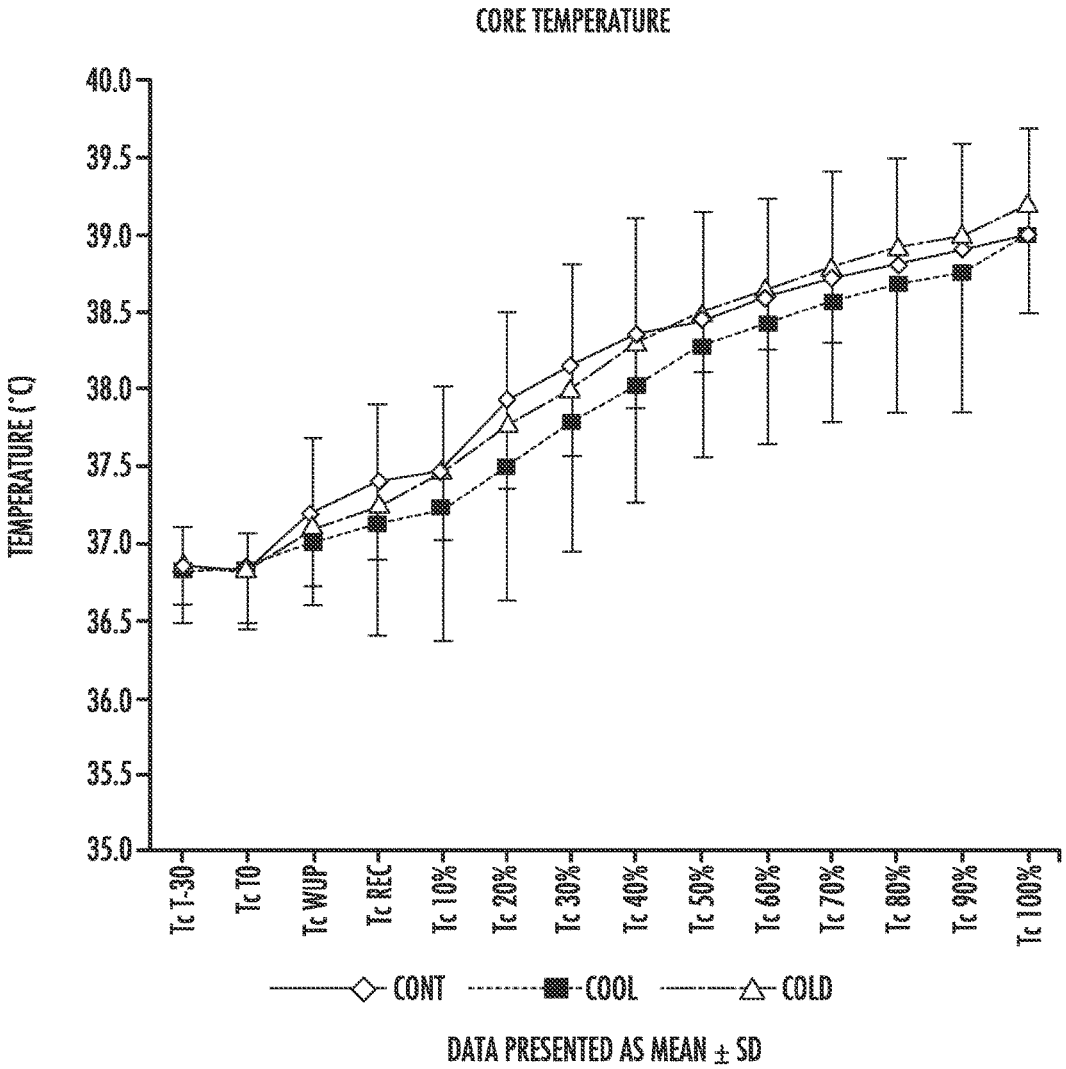
FIG. 18 is a graph showing core temperature changes for each temperature of pre-cooling application.

There was no effect of either time or condition on heart rate, nor was there any significant interaction effects. There was however a trend for heart rate to be elevated throughout the time trial in COOL (172±4) vs. CONT (167±5; $p=0.06$). As illustrated in FIG. 18, there were no significant differences in core temperature between conditions at any time points. There was a trend towards a lower change in $T_c$ throughout the course of the trial for following pre-cooling. COLD was ~0.2° C. lower and COOL~0.3° C. lower than CONT throughout.

Perceptual Measures

Figure 19:
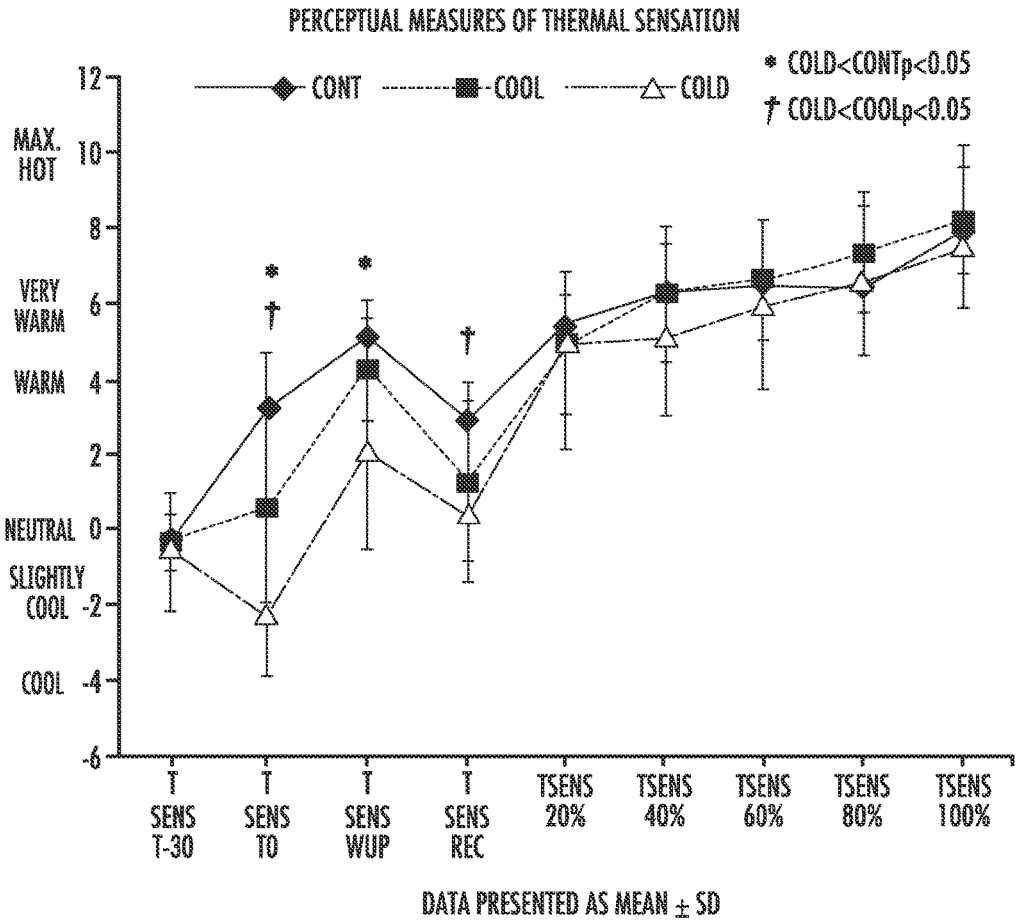
FIG. 19 is a graph showing perceptual measures of thermal sensation for each temperature of pre-cooling application.
Figure 20:
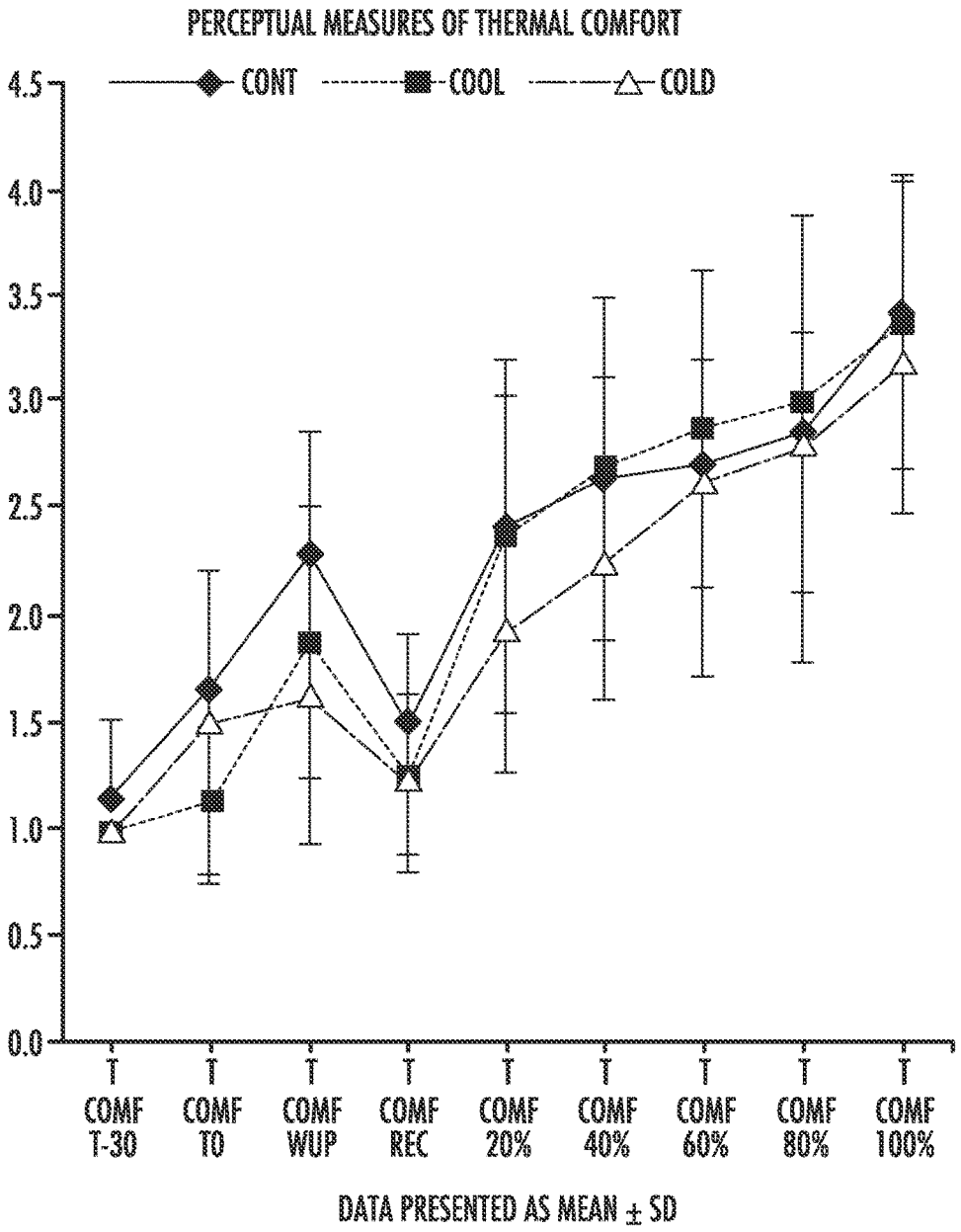
FIG. 20 is a graph showing perceptual measures of thermal comfort for each temperature of pre-cooling application.

As illustrated in FIG. 19, there was a significant effect of both time ($p<0.005$) and condition x time ($p<0.05$) on thermal sensation. An increase in thermal sensation towards feeling "hot" was evident in all conditions throughout the course of the trial. There was a tendency to be more favorable immediately following pre-cooling with both COOL and COLD. There was also a trend for thermal sensation to be lower for both COOL and COLD compared to CONT, and COLD<COOL throughout. This trend reached significance at T0 (COOL<CONT, $p<0.05$; COLD<CONT $p<0.01$), WUP (COOL<CONT, $p<0.05$) and REC (COLD<CONT, $p<0.05$). Pre-cooling application had no effect on either RPE or thermal comfort, even though FIG. 20 shows a small trend towards feeling more comfortable following precooling with COLD.

Discussion

The present data demonstrate that using a novel design of frozen cooling garment which incorporates, torso, hand and forearm cooling resulted in a faster time trial performance (4.8%) in the heat (35° C.) compared to when no pre-cooling was undertaken, and that this effect is independent of changes in $T_c$. Furthermore, the data show that pre-cooling in both conditions lead to a reduction in $T_{sk}$, $T_b$ and $\Delta H_b$, coupled with improvements in thermal sensation at the onset of the time trial. We propose that improvements in performance are due to changes in the peripheral feedback and central regulation of pacing strategies owing to reductions in mean skin temperature. As these reductions are associated with a concurrent improvement in time trial performance, it appears likely that both $T_{sk}$ and $\Delta H_b$ are important in regulating exercise performance in the heat, and that core temperature may have less of a regulatory role than has previously been suggested (Gonzalez-Alonso et al., 1999; Nielsen et al., 1993).

Evidence has begun to emerge that skin temperatures in excess of 35° C. and resultant high skin blood flow requirements can impair prolonged aerobic exercise (Arngrimsson S. A., Stewart D. J., Borrani F., Skinner K. A., and Cureton K. J., *Relation of Heart Rate to Percent VO2 Peak during Submaximal Exercise in the Heat*, J. Appl. Physiol. 2003: 94: 1162-1168; Sawka M. N., Cheuvront S. N., and Kenefick R. W., *High Skin Temperature and Hypohydration Impair Aerobic Performance*, Experimental Physiology 2012: 97: 327-332; Schlader Z., Simmons S., Stannard S., and Mündel T., *Skin Temperature as a Thermal Controller of Exercise Intensity*, Eur. J. Appl. Physiol. 2011: 111: 1631-1639). In environmental conditions similar to those employed in the present study, exhaustion has been shown to occur at relatively low core temperatures (<38.5° C.), but with skin temperatures in excess of 35° C. (Latzka et al., 1998; Montain et al., 1994). This points to the potential importance of an ambient temperature threshold above which pre-cooling is likely beneficial regardless of the rate of heat production.

Despite the obvious difficulties in separating the effect of elevations in both Tc and Tsk, Schlader et al. have demonstrated that when $T_{sk}$ is manipulated from cold to hot via changes in water temperature in a water perfused suit, total work done during 60 minutes of self-paced cycling was higher than when $T_{sk}$ was manipulated from hot to cold, despite similar pre-exercise Tc and heart rate (Schlader et al., 2011). They attribute this to an increase in the initial self-selected power output in the cold to hot condition, suggesting that $T_{sk}$ and the accompanying thermal perceptions are important inputs in the selection of exercise intensity. Similarly, using a 30-minute cycling time trial protocols in hot (32° C.) vs. moderate (23° C.) ambient conditions, Tatterson et al reported that mean power was reduced by 6.5% in a warm environment and was associated with a Tsk of ~33° C. versus 27° C. in cooler ambient conditions, despite similar peak core temperature values in both conditions (Tatterson A. J., Hahn A. G., Martini D. T., and Febbraio M. A., *Effects of Heat Stress on Physiological Responses and Exercise Performance in Elite Cyclists*, Journal of Science and Medicine in Sport 2000: 3: 186-193). In runners, it has been shown that $T_{sk}$ in excess of 34° C. results in a reduction of $VO_2$ max in proportion to the increase in $T_{sk}$ (Arngrimsson et al., 2003). Therefore, in situations where $T_{sk}$ is elevated, such as during prolonged endurance exercise and/or in moderate to warm ambient conditions, an individual will work at a greater percentage of $VO_2$ max for the same relative workload, compared to when $T_{sk}$ is lower or when ambient conditions more temperate.

As a result of elevations in $T_{sk}$, there is an increase in skin blood flow in an attempt to dissipate some of the accumulated heat. The increase in skin blood flow causes redistribution away from the active musculature (Cheuvront S. N., Carter R., 3rd, Castellani J. W., and Sawka M. N., *Hypohydration Impairs Endurance Exercise Performance in Temperate but Not Cold Air*, J. Appl. Physiol. 2005: 99: 1972-1976.; Ely B. R., Cheuvront S. N., Kenefick R. W., and Sawka M. N., *Aerobic Performance is Degraded, Despite Modest Hyperthermia, in Hot Environments*, Med. Sci. Sports Exerc. 2010: 42: 135-141) and can result in hypovolemia, which in itself can lead to a decline in performance in the range of 20% if accompanied by even moderate dehydration (Cheuvront et al., 2005). Although from the present data we are unable to demonstrate a change in skin blood flow, it is well established that vasoconstriction occurs as a consequence of peripheral cooling (Johnson J. M., *Mechanisms of Vasoconstriction with Direct Skin Cooling in Humans*, Am. J. Physiol. Heart Circ. Physiol. 2007: 292: H1690-1691; Wilson T. E., Sauder C. L., Kearney M. L., Kuipers N. T., Leuenberger U. A., Monahan K. D., and Ray C. A., *Skin-Surface Cooling Elicits Peripheral and Visceral Vasoconstriction in Humans*, J. Appl. Physiol. 2007: 103: 1257-1262). Therefore, it is possible that there is greater maintenance of central blood volume following pre-cooling, which allows for greater skeletal muscle blood flow and oxygen delivery during exercise, and assists in improving performance.

Taken together, these studies suggest that hot skin temperatures alone are capable of impairing aerobic performance. In the present study, pre-cooling had the effect of reducing skin temperature, furthermore, the point at which a $T_{sk}$ of 35° C. was reached was delayed for between 14 (COOL) and ~23 minutes (COLD). Therefore, if $T_{sk}$ at the onset of exercise provides important input into initial self-selected power output and thus overall performance, the improvement in both mean power output and time trial performance reported here may be due to a reduction in skin temperature in response to the intensity the pre-cooling interventions used. This adds to the suggestion that hot $T_{sk}$ may have an important regulatory function in the fatigue process via a combination of central and peripheral mechanisms in hot ambient conditions.

Elevations in mean body temperature and body heat storage have also been associated with impaired aerobic performance during exercise in the heat (Hessemer V., Langusch D., Bruck L. K., Bodeker R. H., and Breidenbach T., *Effect of Slightly Lowered Body Temperatures on Endurance Performance in Humans*, J. Appl. Physiol. 1984: 57: 1731-1737; Lee D. T. and Haymes, E. M. *Exercise Duration and Thermoregulatory Responses After Whole Body Precooling*, J. Appl. Physiol. 1995: 79: 1971-1976.; Schmidt V. and Bruck K., *Effect of a Precooling Maneuver on Body Temperature and Exercise Performance*, J. Appl. Physiol. 1981: 50: 772-778.; Tucker R., Marle T., Lambert E. V., and Noakes T. D., *The Rate of Heat Storage Mediates an Anticipatory Reduction in Exercise Intensity during Cycling at a Fixed Rating of Perceived Exertion*, J. Physiol. 2006: 574: 905-915), albeit with considerable debate surrounding this suggestion (Jay O. and Kenny G. P., *Current Evidence does Not Support an Anticipatory Regulation of Exercise Intensity Mediated by Rate of Body Heat Storage*, Journal of Applied Physiology 2009: 107: 630-631; Marino F. E., *Commentaries on Viewpoint: Current Evidence does Not*

*Support an Anticipatory Regulation of Exercise Intensity Mediated by Rate of Body Heat Storage*, Journal of Applied Physiology 2009: 107: 632-634). Our data suggest that an improvement in performance following COLD pre-cooling application may be attributable to the increased intensity of cooling in this condition, thus resulting in a reduction in body heat content at the onset of exercise. This finding replicates those reported by Bogerd et al, who suggest that the reduction in $T_{sk}$, $T_b$ and $\Delta H_b$ content as a result of cooling creates a heat sink that continues during exercise and allow for improved performance (Bogerd N., Perret C., Bogerd C. P., Rossi R. M., and Daanen H. A., *The Effect of Pre-Cooling Intensity on Cooling Efficiency and Exercise Performance*, J. Sports Sci. 2010: 28: 771-779).

Despite its wide usage, it is acknowledged that a calculation for mean body heat content, and therefore $\Delta H_b$, based solely on skin and core temperature has its inherent limitations, due to the over simplification of the core and shell compartmentalization model which does not accurately reflect complex physiological and thermoregulatory processes that are in action during intense exercise.

Thermal sensation was reduced following both COOL and COLD, although the reduction only lasted until the start of the time trial in COLD. Throughout the time trial there was a tendency for thermal sensation to be lower in both pre-cooled conditions versus CONT. Furthermore, when asked, all participants reported that they felt "better" following cooling with both COLD and CONT compared to when no cooling was used and that this was beneficial to their performance. Lowering thermal sensation towards feeling less hot may be of importance in the regulation of pacing strategy selection.

Several authors have reported that perceptual measures are linked to alterations in exercise performance (Bogerd N., Heus R., and Willems J., *The Effect of a Hot Climate and External Cooling on Graded Cycling Performance*, Environmental Ergonomics 2005 2005: 35; Castle P. C., Macdonald A. L., Philip A., Webborn A., Watt P. W., and Maxwell N. S., *Precooling Leg Muscle Improves Intermittent Sprint Exercise Performance in Hot, Humid Conditions*, J. Appl. Physiol. 2006: 100: 1377-1384; Crewe H., Tucker R., and Noakes T. D., *The Rate of Increase in Rating of Perceived Exertion Predicts the Duration of Exercise to Fatigue at a Fixed Power Output in Different Environmental Conditions*, Eur. J. Appl. Physiol. 2008: 103: 569-577; Duffield R., Green R., Castle P., and Maxwell N., *Precooling can Prevent the Reduction of Self-Paced Exercise Intensity in the Heat*, Med. Sci. Sports Exerc. 2010: 42: 577-584; Tucker R., *The Anticipatory Regulation of Performance: The Physiological Basis for Pacing Strategies and the Development of a Perception-Based Model for Exercise Performance*, Br. J. Sports Med. 2009: 43: 392-400).

Siegel et al., (Siegel R., Mate J., Brearley M. B., Watson G., Nosaka K., and Laursen P. B., *Ice Slurry Ingestion Increases Core Temperature Capacity and Running Time in the Heat*, Med. Sci. Sports Exerc. 2010: 42: 717-725) and others (Dugas J., *Ice Slurry Ingestion Increases Running Time in the Heat*, Clin. J. Sport Med. 2011: 21: 541-542; Lee J. K., Shirreffs S. M., and Maughan R. J., *Cold Drink Ingestion Improves Exercise Endurance Capacity in the Heat*, Med. Sci. Sports Exerc. 2008: 40: 1637-1644) have demonstrated that lower thermal sensation following pre-cooling was associated with improved running performance in the heat. It is possible that perceptual measures may act as a way of regulating pace or effort based on an individual's expectations of a task and how it should "feel" when compared to similar tasks they have experience of. Several authors have suggested that these comparisons are used by the central nervous system to regulate work rate in order to complete an event as quickly as possible (Noakes T. D., St Clair Gibson A., and Lambert E. V., *From Catastrophe to Complexity: A Novel Model of Integrative Central Neural Regulation of Effort and Fatigue during Exercise in Humans*, Br. J. Sports Med. 2004: 38: 511-514; Noakes T. D., St Clair Gibson A., and Lambert E. V., *From Catastrophe to Complexity: A Novel Model of Integrative Central Neural Regulation of Effort and Fatigue during Exercise in Humans: Summary and Conclusions*, Br. J. Sports Med. 2005: 39: 120-124; Tucker R., *The Anticipatory Regulation of Performance: The Physiological Basis for Pacing Strategies and the Development of a Perception-Based Model for Exercise Performance*, Br. J. Sports Med. 2009: 43: 392-400). However, the idea of central regulation as an anticipatory controller of exercise performance (Noakes et al., 2004; Noakes et al., 2005; Tucker et al., 2006) is a current area of much debate and controversy (Marcora S., *Counterpoint: Afferent Feedback from Fatigued Locomotor Muscles is Not an Important Determinant of Endurance Exercise Performance*, J. Appl. Physiol. 2010: 108: 454-456; Perrey S., Smirmaul B. d. P. C., Fontes E. B., Noakes T. D., Bosio A., Impellizzeri F. M., Meeusen R., Nakamura F. Y., Abbiss C. R., Peiffer J. J., Smith S. A., Murphy M. N., Bishop D. J., de Vrijer A., Mendez-Villanueva A., Williamson J. W., Girard S. C., Racinais S., Place N., Kayser B., Millet G. P., Millet G. Y., Hettinga F. J., Light A. R., Dousset E., Prilutsky B. I., Gregor R. J., Gagnon P., Saey D., Maltais F., Taylor J. L., Gandevia S. C., Burnley M., Jones A. M., and Wright R. A., *Comments on Point: Counterpoint: Afferent Feedback from Fatigued Locomotor Muscles is/is Not an Important Determinant of Endurance Exercise Performance*, J. Appl. Physiol. 2010: 108: 458-468) and warrants more in-depth investigation.

Studies were then performed to evaluate the performance of the article of wear 10 through benchmark testing against a control suit and two competitor products. One of these competitor products uses ice as its cooling material that is designed to be applied generally to the entire torso ("competitor product 1"). The other competitor product uses liquid absorbing gels as its cooling material that is designed to be applied in regular bands not aligned with any specific regions of the body ("competitor product 2"). The purpose of the benchmarking analysis was to determine if the article of wear 10 is capable of reducing core body temperature and to compare the performance of the article of wear 10 against the control suit and the competitor products 1 and 2.

Using the Article of Wear 10

To activate the article of wear 10, soak the vest and/or the sleeves in water for approximately 4 minutes, then gently squeeze out the water. To achieve the best results, place the article of wear 10 into a freezer at approximately 0° C. for two hours. Once the article of wear 10 has been wet for the first time, it is important that the article of wear 10 remain wet so that the cooling material does not dry out.

Once the article of wear 10 has been conditioned, the article of wear 10 may be worn for approximately 30 minutes prior to beginning physical activity, but should be removed before engaging in physical activity. The article of wear 10 is designed for environmental temperatures of 24° C. and above for optimal effect.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An article of wear comprising:

a base layer;

a plurality of cooling zones attached to the base layer so that substantially all of the plurality of cooling zones are configured to be positioned adjacent regions of a wearer's body having efficient heat transfer properties of a wearer when worn; and cooling material contained within the plurality of cooling zones;

wherein the cooling material is configured to be pre-cooled prior to wearing such that, when pre-cooled, the article of wear is configured to reduce a wearer's body heat content through heat transfer from each region having efficient heat transfer properties to each cooling zone;

wherein the article of wear is configured such that the plurality of cooling zones are positioned adjacent to an upper trapezius region extending across a full width of a wearer's shoulders when worn; and wherein the article of wear is configured such that the plurality of cooling zones are not positioned adjacent to an abdominal area of the wearer's body when worn.

2. The article of wear of claim 1, wherein the cooling material comprises an absorbent material that converts to a semi-solid gel when mixed with water or an aqueous solution, and wherein the absorbent material comprises sodium polyacrylate.

3. The article of wear of claim 1, wherein the cooling material comprises a phase change material that is a solid at room temperature, but undergoes a phase change to a liquid when exposed to skin temperature of approximately 28° C. or above.

4. The article of wear of claim 1, wherein the article of wear comprises at least one sleeve comprising a thumb hole and the article of wear is configured such that the plurality of cooling zones are positioned adjacent to a palm of a wearer's hand when worn.

5. The article of wear of claim 1, wherein the article of wear comprises a vest and a pair of sleeves.

6. The article of wear of claim 1, wherein the wearer's body heat content is reduced by at least 0.3° C. after 30 minutes of wear.

7. An article of wear comprising a vest and a pair of sleeves, each of the vest and the pair of sleeves comprising:

a base layer;

a plurality of cooling zones attached to the base layer so that substantially all of the plurality of cooling zones are configured to be positioned adjacent regions of a wearer's body having efficient heat transfer properties of a wearer when worn; and a cooling material contained within the plurality of cooling zones;

wherein the cooling material is configured to be pre-cooled prior to wearing such that, when pre-cooled, the article of wear is configured to reduce a wearer's body heat content through heat transfer from each region having efficient heat transfer properties to each cooling zone; and wherein the article of wear is configured such that the plurality of cooling zones are positioned adjacent to (i) an upper trapezius region extending across a full width of a wearer's shoulders and (ii) a majority of an anterior and a posterior side of a forearm and a palm of a hand when worn.

8. The article of wear of claim 7, wherein the article of wear is configured such that the plurality of cooling zones are not positioned adjacent to an abdominal area of the wearer's body when worn, and wherein each of the pair of sleeves comprises a thumb hole.

9. The article of wear of claim 7, wherein the cooling material comprises an absorbent material that converts to a semi-solid gel when mixed with water or an aqueous solution, wherein the absorbent material comprises sodium polyacrylate.

10. The article of wear of claim 7, wherein the cooling material comprises a phase change material that is a solid at room temperature, but undergoes a phase change to a liquid when exposed to skin temperature of approximately 28° C. or above.

11. A method of using an article of wear, the method comprising:

providing an article of wear comprising a base layer, a plurality of cooling zones attached to the base layer, and a cooling material contained within the plurality of cooling zones;

activating the cooling material by wetting the article of wear;

pre-cooling the article of wear; and positioning the article of wear on a body of a wearer so that substantially all of the plurality of cooling zones are positioned adjacent regions of the wearer's body having efficient heat transfer properties of the wearer, wherein the article of wear is configured such that the plurality of cooling zones are positioned adjacent to an upper trapezius region extending across a full width of a wearer's shoulders when worn; and wherein the article of wear is configured such that the plurality of cooling zones are configured to be positioned in areas that are not adjacent to locations where vital organs are located when worn.

12. The method of claim 11, wherein the cooling material comprises an absorbent material that converts to semi-solid gel when mixed with water or an aqueous solution.

13. The method of claim 11, wherein positioning the article of wear on the wearer so that substantially all of the plurality of cooling zones are positioned adjacent regions having efficient heat transfer properties of the wearer comprises positioning a pair of sleeves over each forearm and wrist of the wearer, wherein each sleeve comprises a thumb hole.

14. The method of claim 13, wherein positioning the article of wear on the wearer so that substantially all of the plurality of cooling zones are positioned adjacent regions having efficient heat transfer properties of the wearer further comprises positioning a vest over a torso of the wearer, wherein the article of wear is configured such that the plurality of cooling zones are not positioned adjacent to an abdominal area of the wearer's body when worn.

15. The method of claim 11, further comprising reducing a wearer's body heat content through heat transfer from each region having efficient heat transfer properties to each cooling zone.

16. The method of claim 11, further comprising reducing a wearer's body heat content by at least 0.3° C. after 30 minutes of wear.

17. The method of claim 11, wherein pre-cooling the article of wear comprises pre-cooling the article of wear at approximately 0° C. for two hours prior to wearing.

18. The article of wear of claim 1, wherein the article of wear is configured such that the plurality of cooling zones are positioned adjacent to both latissimus dorsi regions of the wearer's back without covering a portion of a spine between the latissimus dorsi regions when worn.

19. The article of wear of claim 1, wherein the article of wear is configured such that the plurality of cooling zones are configured to be positioned in areas that are not adjacent to locations where vital organs are located when worn.

20. The article of wear of claim 4, wherein the article of wear is configured such that the plurality of cooling zones are positioned adjacent to a dorsal side of a wearer's hand when worn.

21. The article of wear of claim 7, wherein:

the article of wear is configured such that the plurality of cooling zones are positioned adjacent to at least one of (i) both latissimus dorsi regions of the wearer's back and (ii) a dorsal side of the wearer's hand when worn; and the article of wear is configured such that the plurality of cooling zones are not positioned adjacent to a center and lower portion of a wearer's spine when worn.

* * * * *